US012096799B2

(12) United States Patent
Liu et al.

(10) Patent No.: US 12,096,799 B2
(45) Date of Patent: Sep. 24, 2024

(54) ELECTRONIC CIGARETTE ATOMIZER AND ELECTRONIC CIGARETTE

(71) Applicant: CHINA TOBACCO HUNAN INDUSTRIAL CO., LTD., Hunan (CN)

(72) Inventors: Jianfu Liu, Hunan (CN); Kejun Zhong, Hunan (CN); Xiaoyi Guo, Hunan (CN); Wei Huang, Hunan (CN); Xinqiang Yin, Hunan (CN); Jianhua Yi, Hunan (CN); Chaoxiang Huang, Hunan (CN); Yongquan Zhou, Hunan (CN)

(73) Assignee: CHINA TOBACCO HUNAN INDUSTRIAL CO., LTD., Hunan (CN)

( * ) Notice: Subject to any disclaimer, the term of this patent is extended or adjusted under 35 U.S.C. 154(b) by 676 days.

(21) Appl. No.: 17/254,758

(22) PCT Filed: Jun. 20, 2019

(86) PCT No.: PCT/CN2019/092064
§ 371 (c)(1),
(2) Date: Dec. 21, 2020

(87) PCT Pub. No.: WO2019/242682
PCT Pub. Date: Dec. 26, 2019

(65) Prior Publication Data

US 2021/0267279 A1 Sep. 2, 2021

(30) Foreign Application Priority Data

Jun. 22, 2018 (CN) ..... 201810649965.1
Jun. 22, 2018 (CN) ..... 201820967344.3

(51) Int. Cl.
*A24F 40/485* (2020.01)
*A24F 40/10* (2020.01)
*A24F 40/60* (2020.01)

(52) U.S. Cl.
CPC ..... *A24F 40/485* (2020.01); *A24F 40/10* (2020.01); *A24F 40/60* (2020.01)

(58) Field of Classification Search
None
See application file for complete search history.

(56) References Cited

U.S. PATENT DOCUMENTS 4,032,050 A * 6/1977 Funk ..... G01F 11/24 222/362
9,596,887 B2 3/2017 Newton
(Continued)

FOREIGN PATENT DOCUMENTS

CN 206453237 U 9/2017
CN 206547880 U 10/2017
(Continued)

OTHER PUBLICATIONS

Liu et al., Atomizer—English Translation, Mar. 2023, European Patent Office (Year: 2023).*
(Continued)

*Primary Examiner* — Russell E Sparks
(74) *Attorney, Agent, or Firm* — MASCHOFF BRENNAN; Ran Pang; Michael Mauriel

(57) ABSTRACT

An electronic cigarette atomizer and an electronic cigarette are disclosed. The electronic cigarette atomizer comprises an air inlet (1), an air inlet passage (2), an atomization cavity (3), an air outlet passage (4), an air outlet (5), and a suction nozzle (6) communicated sequentially, and further comprises an adjustment mechanism (7) for adjusting the air output of the air outlet. The adjustment mechanism (7)
(Continued)

simultaneously adjusts the air input of the air inlet (1) and the air output of the air outlet (5). The electronic cigarette atomizer can adjust the air output of the air outlet (5) of the atomizer and can meet the needs of users with different lung capacities for different smoke concentration adjustment modes. The electronic cigarette atomizer can simultaneously adjust the air flow at the air inlet (1) and the air outlet (5) of the atomizer.

12 Claims, 17 Drawing Sheets

(56) References Cited

U.S. PATENT DOCUMENTS

| | | | | |
|---|---|---|---|---|
| 9,795,166 | B2 * | 10/2017 | Liu | A24F 40/40 |
| 10,045,568 | B2 * | 8/2018 | Monsees | H05B 3/44 |
| 10,244,793 | B2 * | 4/2019 | Monsees | H05B 3/146 |
| 10,772,357 | B2 * | 9/2020 | Saygili | A24F 40/42 |
| 2013/0087160 | A1 * | 4/2013 | Gherghe | A24F 40/90 131/329 |
| 2013/0112778 | A1 * | 5/2013 | Hiemer | B01F 25/4321 239/398 |
| 2019/0289914 | A1 * | 9/2019 | Liu | A24F 40/42 |

FOREIGN PATENT DOCUMENTS

| | | | | | |
|---|---|---|---|---|---|
| CN | 208354603 | U | | 1/2019 | |
| CN | 208434717 | U | | 1/2019 | |
| KR | 20170125064 | A | * | 11/2017 | A24F 47/008 |
| WO | 2015149311 | A1 | | 10/2015 | |
| WO | WO-2017215221 | A1 | * | 12/2017 | A24F 40/05 |
| WO | WO-2018018369 | A1 | * | 2/2018 | A24F 47/00 |
| WO | WO-2018218421 | A1 | * | 12/2018 | |

OTHER PUBLICATIONS

Xiang et al., Atomizing Assembly—English Translation, Mar. 2023, European Patent Office (Year: 2023).*

Zhong et al., Ultrasonic electronic cigarette atomizer and electronic cigarette—English Translatio, Mar. 2023, European Patent Office (Year: 2023).*

Hepworth et al., Apparatus for Generating an Inhalable Medium—English Translation, Jan. 17, 2023, European Patent Office (Year: 2023).*

International Search Report issued in International Application No. PCT/CN2019/092064 dated Oct. 8, 2019, 2 pages.

* cited by examiner

ELECTRONIC CIGARETTE ATOMIZER AND ELECTRONIC CIGARETTE

CROSS REFERENCE TO RELATED APPLICATIONS

This application is a U.S. National Phase application under 35 U.S.C. § 371 of International Application No. PCT/CN2019/092064 filed on Jun. 20, 2019, which claims priority to Chinese Application No. 201810649965.1 filed on Jun. 22, 2018, and Chinese Application No. 201820967344.3 filed on Jun. 22, 2018.

FIELD OF THE INVENTION

The present invention relates to an electronic cigarette atomizer and an electronic cigarette.

BACKGROUND OF THE INVENTION

In an electronic cigarette atomizer, an air inlet, an air inlet passage, an atomization cavity, an air outlet passage, an air outlet, and a suction nozzle are communicated in sequence. When smoking, air enters the atomization cavity from the air inlet through the air inlet passage, and takes away smoke in the atomization cavity, and then the smoke enters the user's mouth through the air outlet passage, the air outlet and the suction nozzle in turn for the user to smoke.

In the prior art, in order to meet the needs of users with different lung capacities for smoking air flow, an air adjusting ring is generally arranged at the air inlet. The size of the air inlet is adjusted by using the air adjusting ring.

The air adjustment mode of the existing electronic cigarette atomizer has the following disadvantages:

First, no structure is provided for adjusting the air output of the air outlet of the electronic cigarette atomizer, which cannot meet the needs of different users for different adjustment modes, and the user experience is poor.

Second, since the air output of the air outlet is not adjusted simultaneously with the air input of the air inlet, after the air inlet is adjusted, the air flow from the inlet to the outlet and the air outlet of the air flow passage does not change simultaneously. The flow rates at the air inlet and the air outlet are different, so the smoke flow does not combine "torrent" with air, the concentration of smoke sucked by the user sometimes increases and sometimes decreases, the taste of each puff is different, and the user experience is poor. Meanwhile, since the flow rates of air at the air inlet and the air outlet are different, and the air flow between the air flow passage behind the air inlet and the air outlet is the same, the smoke is easily accumulated in the air flow passage with the same flow rate, and the smoke in this segment of air flow passage is extremely easy to condense into e-liquid drops. When the user smokes again, the user sucks small particles of e-liquid drops, which makes the user feel that the e-liquid is sucked, and the user experience is poor.

Third, in the process of rotating the air adjusting ring, the sealing ring between the air adjusting ring and the air inlet is prone to wrinkles and deformation, resulting in large friction, poor sealing performance, and inconvenient adjustment. The holding portion of the air adjusting ring is very small in area, so that the force is difficult to apply, control and adjust, resulting in difficult adjustment to the required air input.

SUMMARY OF THE INVENTION

In view of the above shortcomings of the prior art, the objective of the present invention is to provide an improved electronic cigarette atomizer and an electronic cigarette, which can adjust the air output of an air outlet of the atomizer, can meet the needs of users with different lung capacities for different smoke concentration adjustment modes, are convenient to adjust, can adjust the air flow at an air inlet and the air outlet of the atomizer at the same time, have stable smoke, avoid sucking e-liquid drops, and have good smoke taste.

In order to solve the above technical problems, the technical solution adopted by the present invention is as follows:

An electronic cigarette atomizer comprises an air inlet, an air inlet passage, an atomization cavity, an air outlet passage, an air outlet, and a suction nozzle communicated sequentially, and further comprises an adjustment mechanism for adjusting the air output of the air outlet.

With the above structure, air flow (smoke) passing through the air outlet per unit time can be increased or decreased by adjusting the air output of the air outlet, so as to meet the needs of users with different lung capacities for different smoke adjustment modes: before smoke passes through the air outlet, the smoke is not mixed uniformly with air in the air inlet passage. Because the air outlet area of the air outlet is adjusted and restricted by the adjustment mechanism, the flow rate of air flow discharged from the air outlet is changed, the smoke after passing through the air outlet is mixed with the air more uniformly, and the smoke that finally reaches the suction nozzle has a more delicate taste, which improves the user experience.

Further, the adjustment mechanism simultaneously adjusts the air input of the air inlet and the air output of the air outlet.

With the above structure, the flow rate of air flow in the electronic cigarette atomizer is kept consistent in air input and output phases by adjusting the air flow at the air inlet and the air outlet of the atomizer simultaneously, which ensures more uniform collision mixing of smoke and air at the air outlet, so that the amount and concentration of the smoke entering the user's mouth per unit time are consistent. The phenomenon of condensation caused by accumulation of smoke in the air flow passage between the air inlet and the air outlet can also be avoided. The user is prevented from sucking e-liquid, and the taste of smoke is improved. At the same time, the air flow at the air inlet and the air outlet of the atomizer are adjusted simultaneously, which can also meet the needs of users with different lung capacities for different amounts of smoke.

Further, the electronic cigarette atomizer further comprises a housing: the air inlet passage, the atomization cavity, and the air outlet passage are all arranged in the housing; and the top of the housing is provided with a top cover.

The adjustment mechanism comprises a movable member located in the top cover and movable axially along the top cover, the movable member is provided with the air outlet, and a limiting plate opposite to the opening of the air outlet is arranged in the top cover; and when the movable member moves axially along the top cover, the air outlet on the movable member moves relative to the limiting plate to adjust the air output of the air outlet.

With the above structure, when the movable member moves axially along the top cover, the area of the air outlet blocked by the limiting plate is changed to adjust the air output of the air outlet.

Further, the air inlet is formed on a side wall of the top cover, the movable member is provided with an air passage hole opposite to the air inlet for communicating the air inlet with the air inlet passage, and the opening area of the air inlet is smaller than or equal to that of the air passage hole.

With the above structure, when the movable member moves axially along the top cover, the area of the air outlet blocked by the limiting plate is changed, thereby adjusting the air output of the air outlet: when the air output is adjusted, the air passage hole on the movable member can also moves relative to the air inlet to adjust the amount of air entering the air inlet passage, which can adjust the air input of the air inlet, so that the function of adjusting the air input or the amount of smoke by only one part can be realized, the operation is simple, convenient and fast, the sealing performance is good, and the taste of smoke can be kept consistent.

By adjusting the air output and the air input of the air inlet at the same time, the linkage of multiple adjustment stages is realized, the adjusted air flow is more accurate. The modes of smoking by user's lung and mouth can be switched while the requirements of users for smoke taste (preventing sucking small e-liquid drops and smoke concentration) are met, and the user experience is improved. In the prior art, the size of the air inlet is adjusted by using an air adjusting ring, and in the process of rotating the air adjusting ring, the sealing ring between the air adjusting ring and the air inlet is prone to wrinkles and deformation, so the sealing performance is poor, the rotation resistance increases, and the adjustment is inconvenient. Compared with the prior art, the linkage adjustment of the air flow in the present invention is convenient and quick, accurate and satisfactory, with good sealing performance.

Further, the suction nozzle is sleeved outside the top cover and is rotatable relative to the top cover; and the rotation of the suction nozzle drives the movable member to move axially along the top cover.

With the above structure, the movable member can be moved by rotating the suction nozzle, which realizes stepless adjustment on the air flow of the air outlet. Since the holding area of the suction nozzle is large, the rotation force during the rotation can be conveniently controlled, and the operation is simple.

Further, the electronic cigarette atomizer further comprises a limiting mechanism for preventing the axial movement of the suction nozzle relative to the top cover.

As a preferred mode, the top of the inner side wall of the suction nozzle is screwed to the top of the outer side wall of the movable member.

With the above structure, the suction nozzle is screwed to the top cover, while the limiting mechanism limits the axial movement of the suction nozzle relative to the top cover, so when the suction nozzle is rotated, the movable member moves axially under the drive of the suction nozzle, thereby adjusting the area of the air outlet blocked by the limiting plate to increase or decrease the air flow passing through the air outlet in a unit time. When the suction nozzle is rotated and the movable member moves away from the suction nozzle, the area of the air outlet blocked by the limiting plate gradually increases, that is, the air flow passing through the air outlet per unit time decreases. When the suction nozzle is rotated and the movable member moves close to the suction nozzle, the area of the air outlet blocked by the limiting plate gradually decreases, that is, the air flow passing through the air outlet per unit time increases.

As another preferred mode, the inner top surface of the suction nozzle is a first inclined surface, and the outer top surface of the movable member is a second inclined surface: a reset spring is sleeved outside the movable member, one end of the reset spring abuts against a boss of the side wall of the movable member, and the other end of the reset spring abuts against the top of the top cover: when a high end of the first inclined surface abuts against a high end of the second inclined surface, and a low end of the first inclined surface abuts against a low end of the second inclined surface, the area of the air outlet blocked by the limiting plate is minimum and the opening of the air outlet is maximum: when the high end of the first inclined surface is opposite to the low end of the second inclined surface, and the low end of the first inclined surface abuts against the high end of the second inclined surface, the area of the air outlet blocked by the limiting plate is maximum and the opening of the air outlet is minimum.

With the above structure, the mouthpiece is rotated, when the high end of the first inclined surface is opposite to the low end of the second inclined surface and the low end of the first inclined surface abuts against the high end of the second inclined surface, the reset spring is compressed, the movable member moves away from the suction nozzle axially along the top cover, the area of the air outlet blocked by the limiting plate is maximum and the opening of the air outlet is minimum, which conforms to the smoking habits of users with small lung capacities. and the suction nozzle is rotated, when the high end of the first inclined surface abuts against the high end of the second inclined surface and the low end of the first inclined surface abuts against the low end of the second inclined surface, the reset spring returns to a normal state, the movable member moves close to the suction nozzle axially along the top cover, the area of the air outlet blocked by the limiting plate is minimum and the opening of the air outlet is maximum, which conforms to the smoking habits of users with large lung capacities.

As a preferred mode, the limiting mechanism comprises a first limiting step arranged on the inner side wall of the suction nozzle, and a second limiting step arranged on the outer side wall of the top cover and matching the first limiting step.

The first limiting step on the suction nozzle and the second limiting step on the top cover are buckled with each other, so that the suction nozzle can only rotate but cannot move axially after being assembled with the top cover.

As a preferred mode, an ultrasonic atomization sheet is arranged in the atomization cavity, and an e-liquid bin and atomization cotton communicating the e-liquid bin with an atomization surface of the ultrasonic atomization sheet are arranged in the housing: the atomizer further comprises an air inlet pipe, and the inner cavity of the air inlet pipe forms the air inlet passage: an air inlet end of the air inlet pipe is connected to the movable member, and an air outlet end of the air inlet pipe is arranged opposite to the atomization cotton on the atomization surface of the ultrasonic atomization sheet.

With the above structure, since the air inlet pipe is fixed on the movable member, the distance between the air inlet pipe and the atomization cotton is also adjusted when the size of the air outlet is adjusted. When the movable member moves, the air inlet pipe also moves, and the distance from the air outlet end of the air inlet pipe to the atomization cotton increases or decreases, which affects the impact of the inlet air flow on the surface of the atomization cotton in the atomization region, thereby adjusting smoke concentration (that is, whether the smoke is fully carried away by the air flow) and preventing small e-liquid drops from being carried out by the air flow. When the distance between the air outlet end of the air inlet pipe and the atomization cotton decreases, the impact of the air flow on the surface of the atomization cotton increases during smoking, which can blow off the condensed e-liquid, avoid soaking the ultrasonic atomization sheet in the e-liquid, speed up the emission of smoke, prevent sucking the small e-liquid drops taken out, and can fully take away the smoke and increase the smoke concentration.

As another preferred mode, an ultrasonic atomization sheet is arranged in the atomization cavity, and an e-liquid bin and atomization cotton communicating the e-liquid bin with an atomization surface of the ultrasonic atomization sheet are arranged in the housing: the atomizer further comprises an air inlet pipe, and the inner cavity of the air inlet pipe forms the air inlet passage: an air inlet end of the air inlet pipe is connected to the top cover, and an air outlet end of the air inlet pipe is opposite to the atomization cotton on the atomization surface of the ultrasonic atomization sheet.

With the above structure, since the air inlet pipe is fixed on the top cover, when the movable member moves, the position of the air inlet pipe does not change, that is, the distance between the air outlet end of the air inlet pipe and the atomization cotton does not change, which can prevent the user from sucking e-liquid.

Further, a first sealing ring is arranged between the movable member and the top cover to ensure the sealing performance.

Based on the same inventive concept, the present invention further provides an electronic cigarette, comprising the electronic cigarette atomizer.

Compared with the prior art, the present invention can adjust the air output of the air outlet of the atomizer, can meet the needs of users with different lung capacities for different smoke concentration adjustment modes, can simultaneously adjust the air flow at the air inlet and the air outlet of the atomizer, has stable smoke amount and good smoke taste, avoids sucking e-liquid drops, and is convenient, simple and quick to adjust, more practical, and better in user experience effect.

Figure 1:
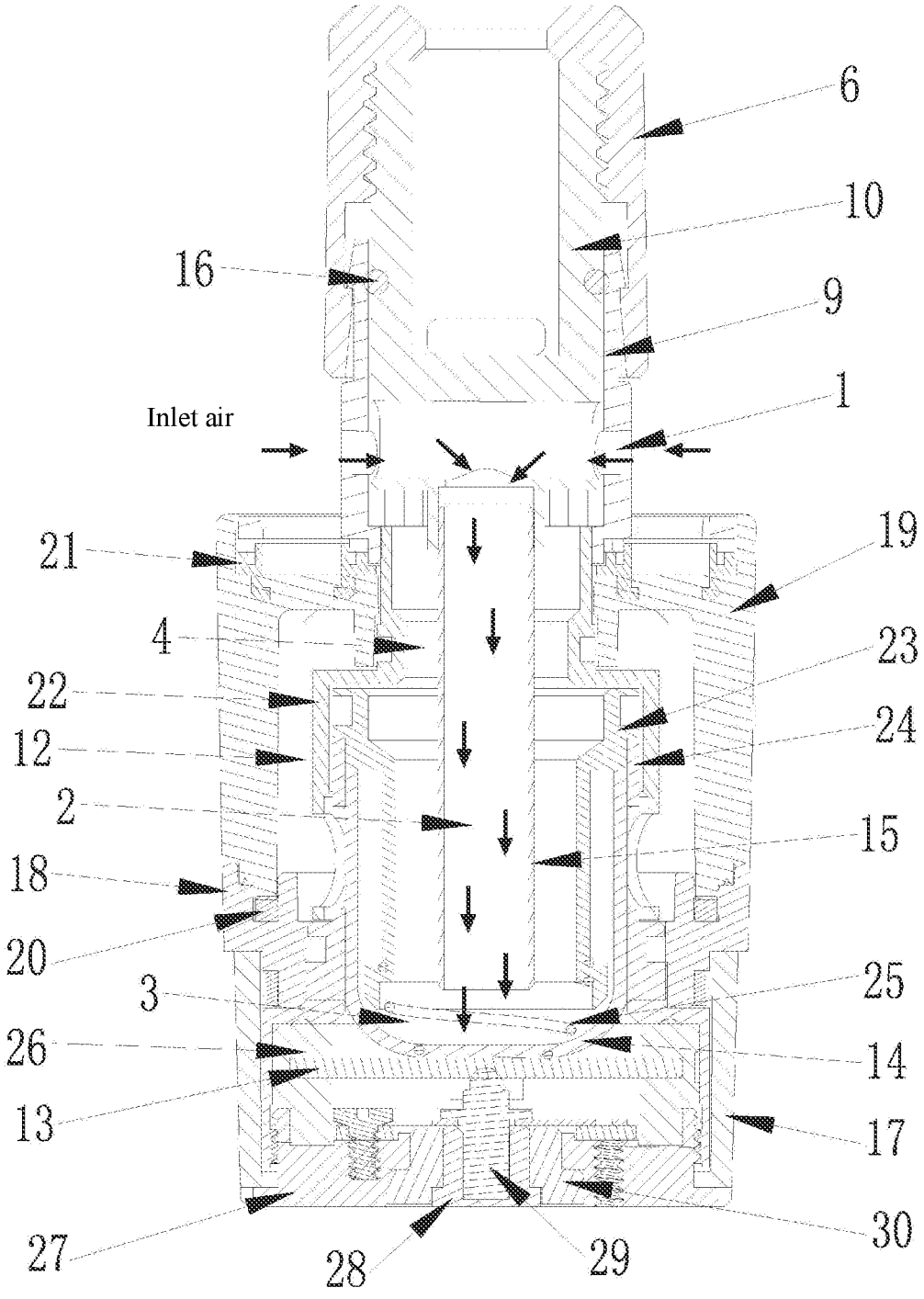
FIG. 1 is a schematic structural diagram of Embodiment 1 of an atomizer.
Figure 2:
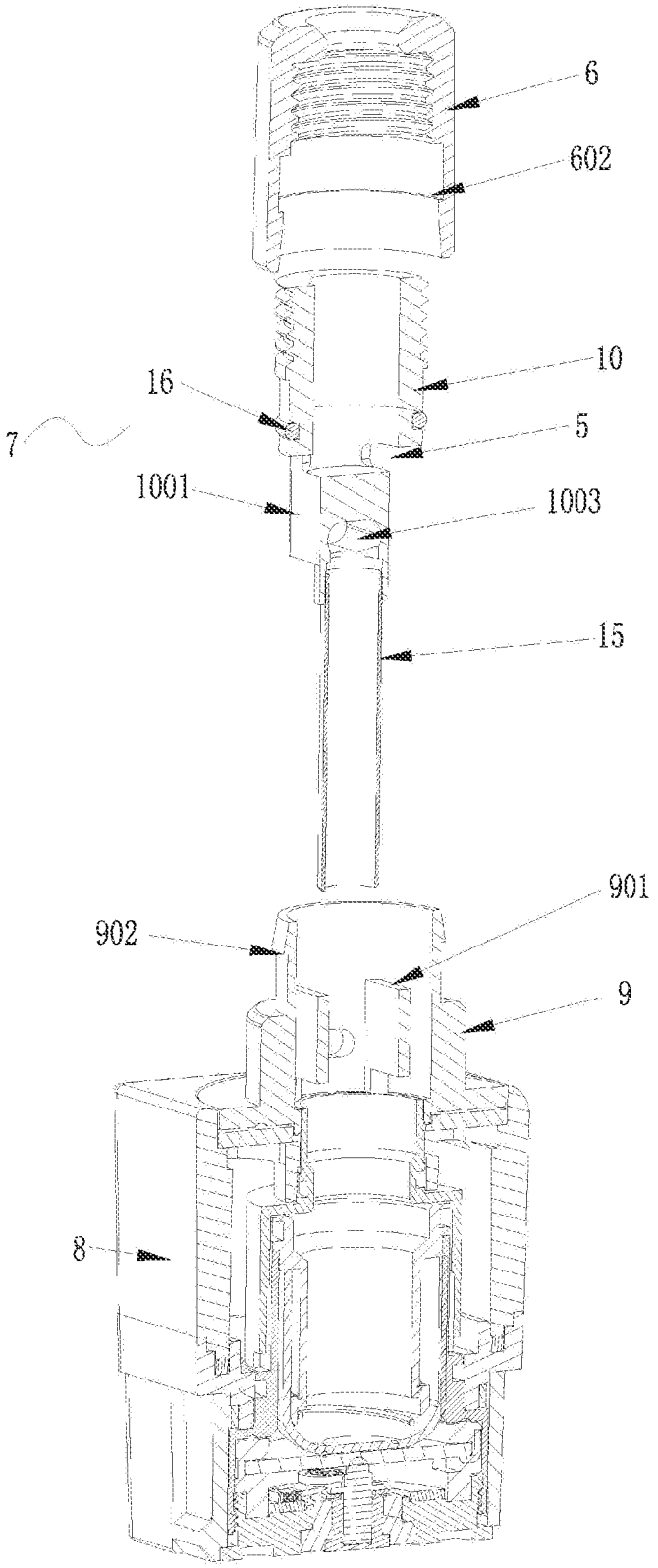
FIG. 2 is a partially exploded view of FIG. 1.
Figure 3:
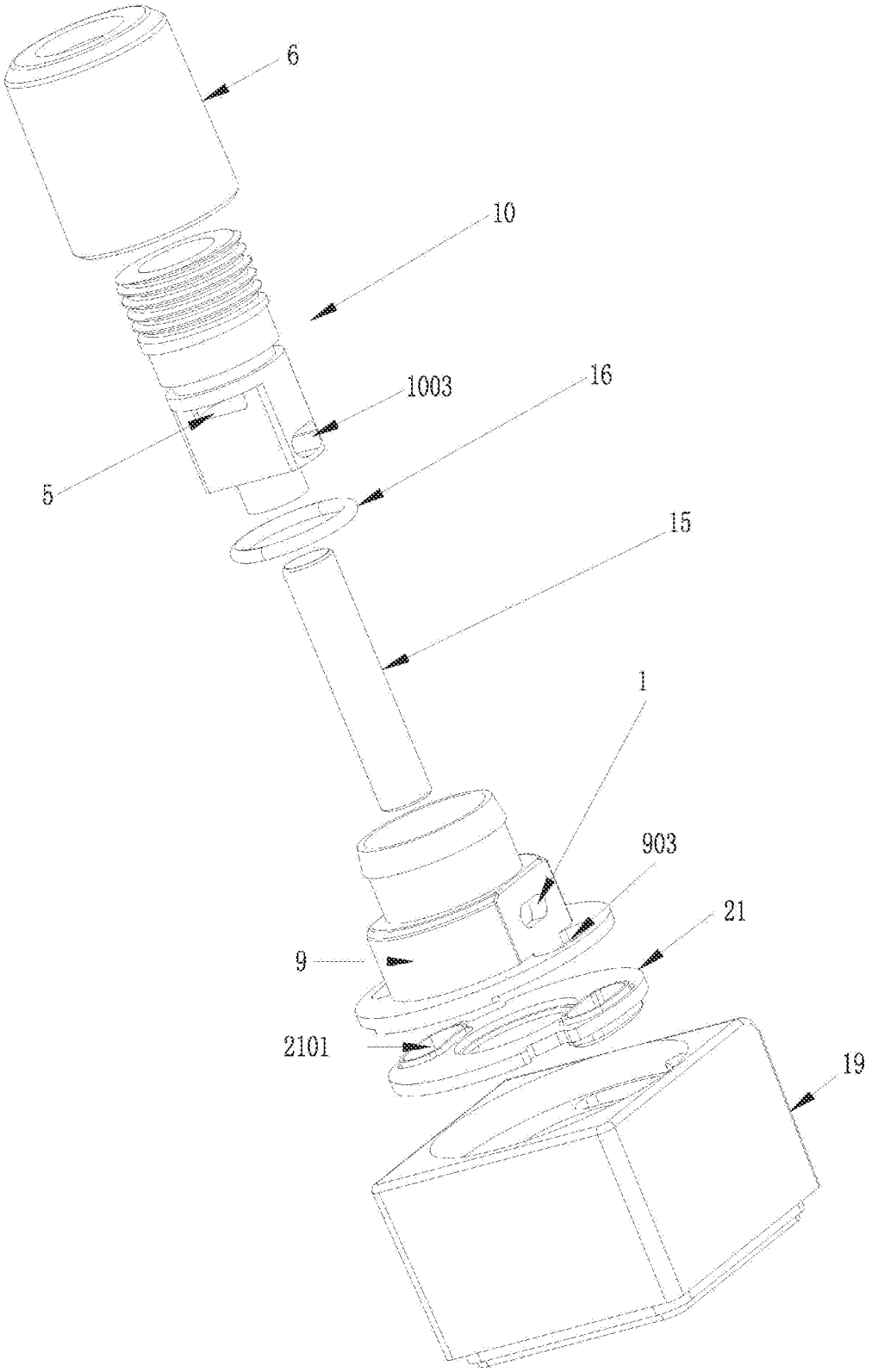
FIG. 3 is an exploded view of the upper part in FIG. 1.
Figure 4:
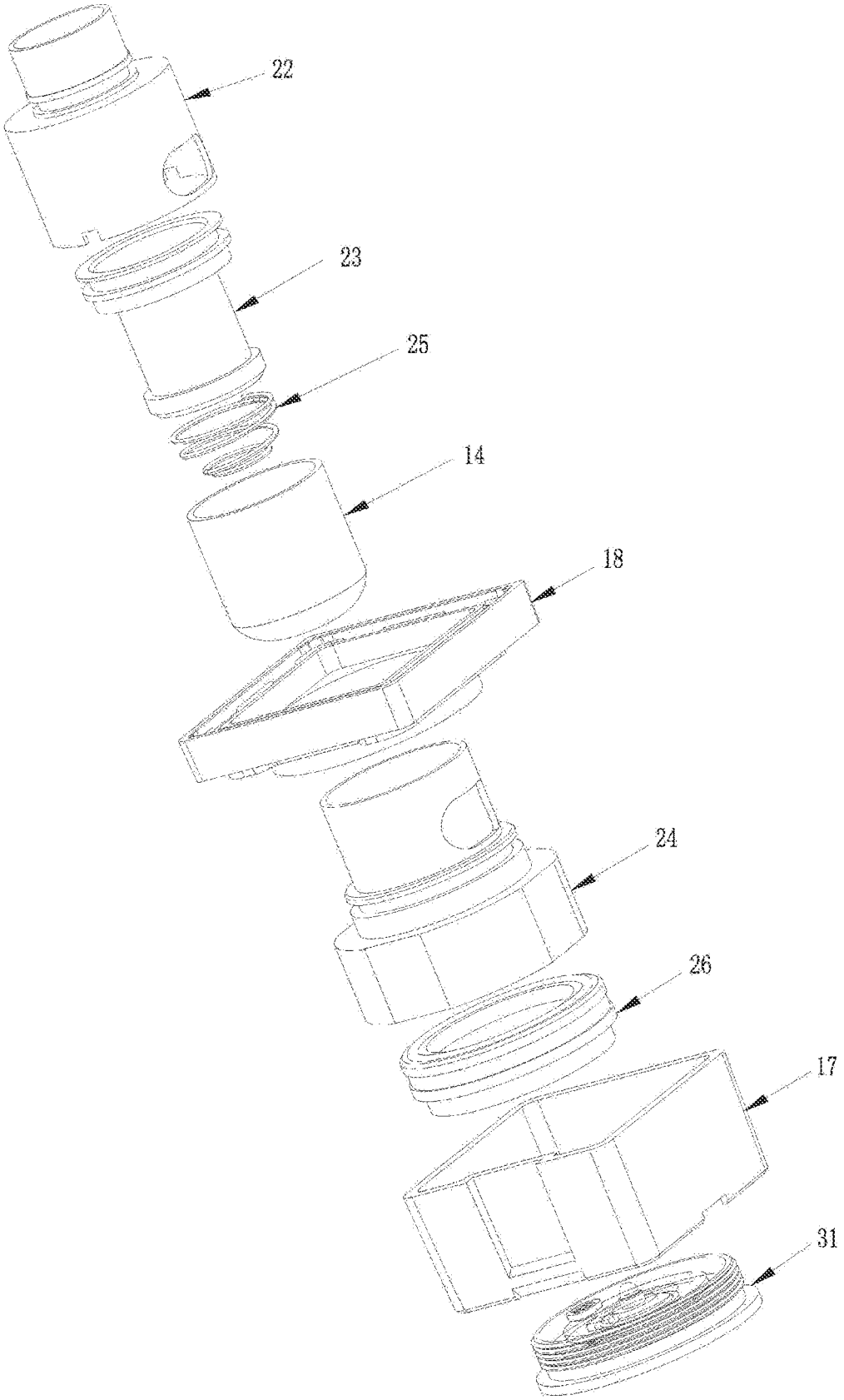
FIG. 4 is an exploded view of the lower part in FIG. 1.

In the figures: 1 air inlet, 2 air inlet passage, 3 atomization cavity, 4 air outlet passage, 5 air outlet, 6 suction nozzle, 601 first inclined surface, 602 first limiting step, 7 adjustment mechanism, 8 housing, 9 top cover, 901 limiting plate, 902 second limiting step, 903 e-liquid injection hole, 10 movable member, 1001 limiting surface, 1002 second inclined surface, 1003 air passage hole, 11 reset spring, 12 e-liquid bin, 13 ultrasonic atomization sheet, 14 atomization cotton, 15 air inlet pipe, 16 first sealing ring, 17 bottom cover, 18 lower cover, 19 upper cover, 20 second sealing ring, 21 sealing gasket, 2101 through hole, 22 connection sleeve, 23 inner sleeve, 24 outer sleeve, 25 cotton pressing spring, 26 atomization seat, 27 threaded seat, 28 lower electrode, 29 spring electrode, 30 insulating ring, 31 bottom cover component.

DETAILED DESCRIPTION OF EMBODIMENTS

Embodiment 1

As shown in FIGS. 1 to 6, embodiment 1 of an electronic cigarette atomizer comprises an air inlet 1, an air inlet passage 2, an atomization cavity 3, an air outlet passage 4, an air outlet 5, and a suction nozzle 6 communicated in sequence, and further comprises an adjustment mechanism 7 for adjusting the air output of the air outlet 5. The atomization cavity 3 is a cavity with a smoke emitting element inside.

By adjusting the air output of the air outlet 5, air flow (smoke) passing through the air outlet 5 per unit time can be increased or decreased, so as to meet the needs of users with different lung capacities for different smoke adjustment modes. Before smoke passes through the air outlet 5, the smoke is not mixed uniformly with air in the air inlet passage 2. Because the air outlet area of the air outlet 5 is adjusted and restricted by the adjustment mechanism 7, the flow rate of air flow discharged from the air outlet 5 is changed, then the smoke after passing through the air outlet 5 is mixed with the air more uniformly, and the smoke that finally reaches the suction nozzle 6 has a more delicate taste, which improves the user experience.

The electronic cigarette atomizer further comprises a housing 8. The air inlet passage 2, the atomization cavity 3, and the air outlet passage 4 are all arranged in the housing 8. The top of the housing 8 is provided with a top cover 9. The adjustment mechanism 7 comprises a movable member 10 located in the top cover 9 and movable axially along the top cover 9. A first sealing ring 16 is arranged between the movable member 10 and the top cover 9. The movable member 10 is provided with the air outlet 5 and a limiting surface 1001, and a limiting plate 901 opposite to the opening of the air outlet 5 for adjusting the size of the opening of the air outlet 5 is arranged in the top cover 9. During assembly, the limiting surface 1001 of the movable member 10 is clamped in the limiting plate 901 to prevent the movable member 10 from rotating in the top cover 9: at the same time, when the movable member 10 moves axially along the top cover 9, the air outlet 5 on the movable member 10 moves relative to the limiting plate 901, so that the size of the air outlet 5 can be adjusted, and then the air output of the air outlet 5 can be adjusted.

Figure 5:
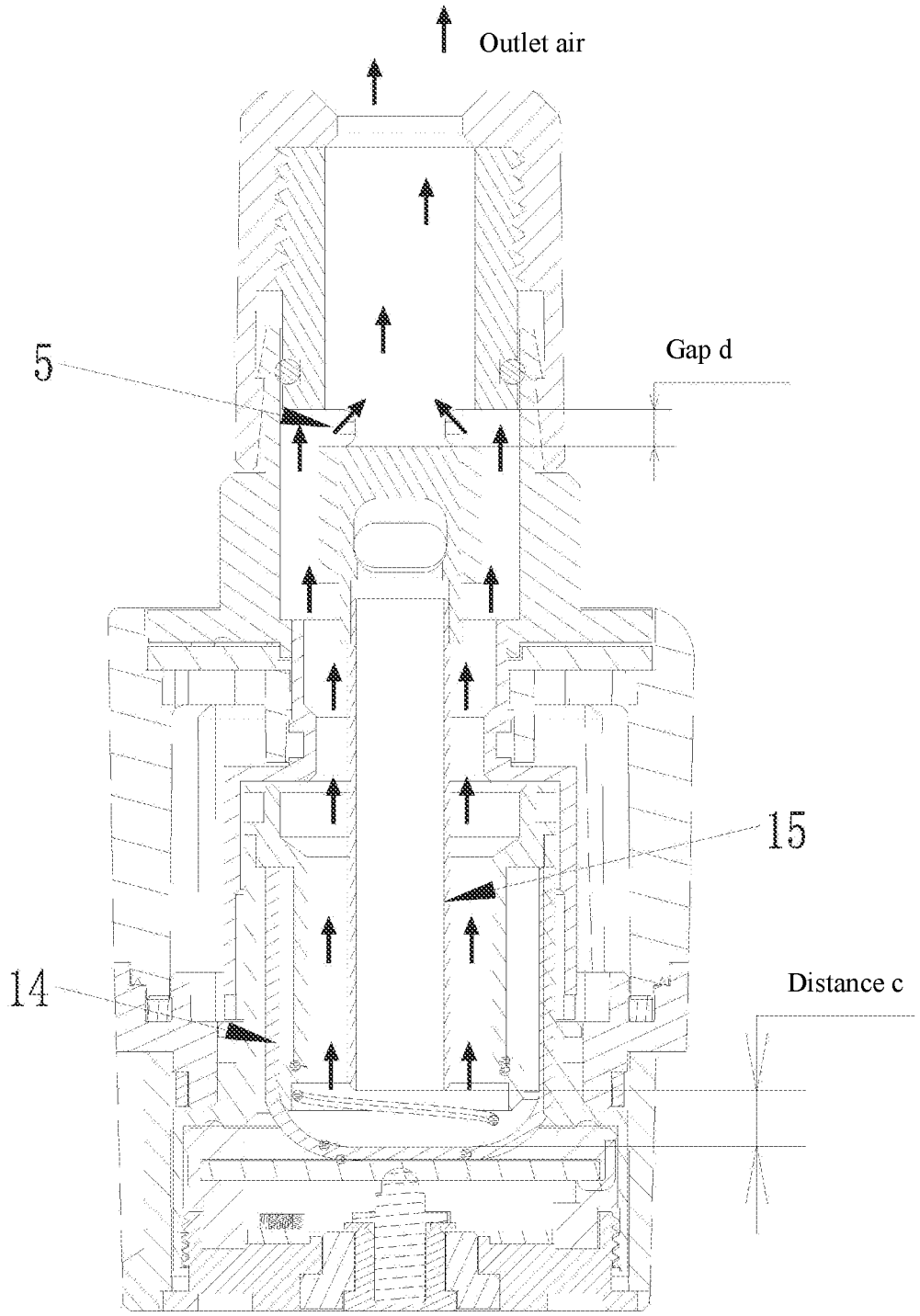
FIG. 5 is a diagram of a use state when the air output of the air outlet is maximum in Embodiment 1.
Figure 6:
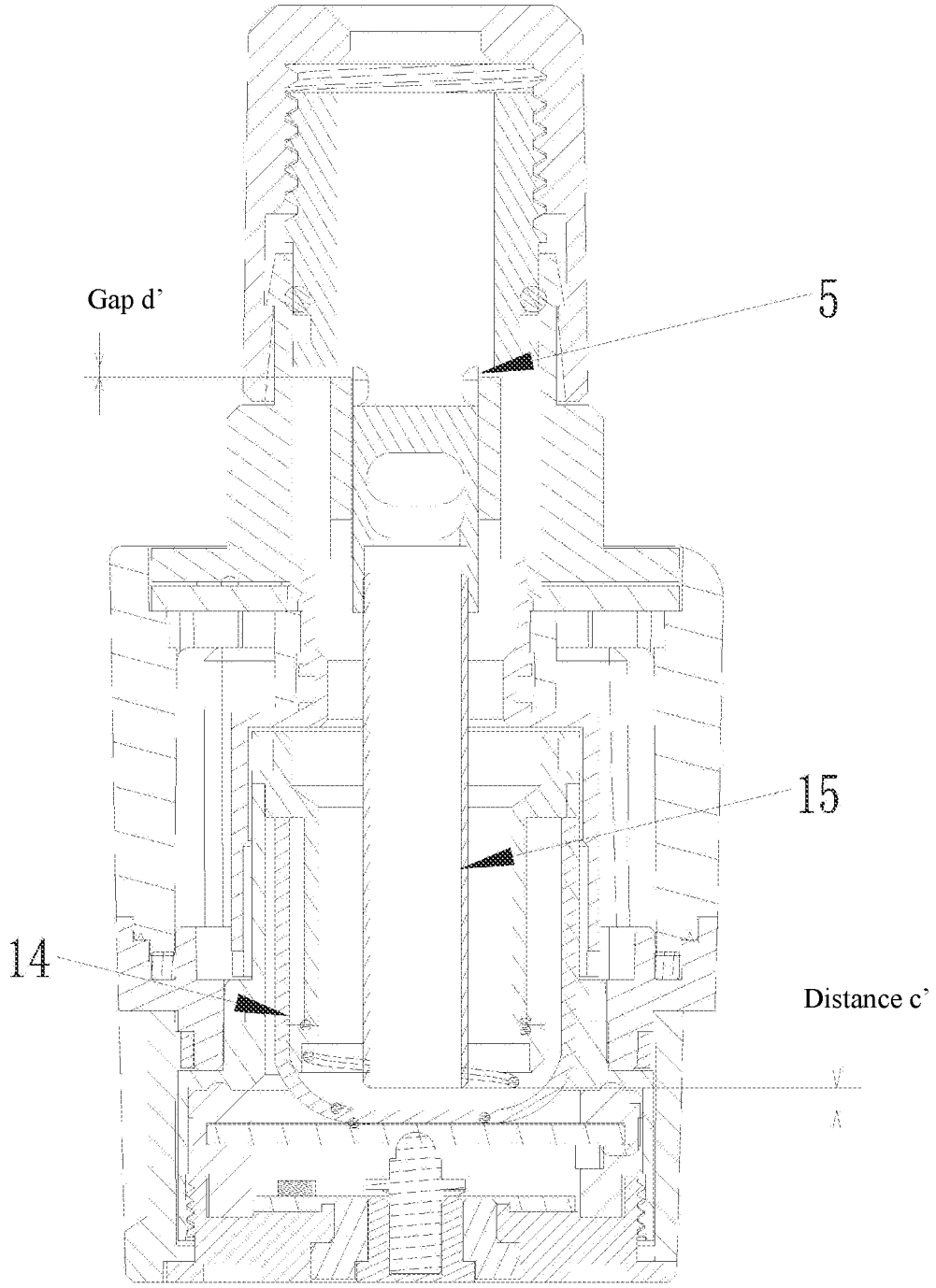
FIG. 6 is a diagram of a use state when the air output of the air outlet is smaller in Embodiment 1.

The suction nozzle 6 is sleeved outside the top cover 9 and is rotatable relative to the top cover 9. When the suction nozzle 6 is rotated, the movable member 10 is driven to move axially along the top cover 9, thereby adjusting the area of the air outlet 5 blocked by the limiting plate 901, to increase or decrease the air flow passing through the air outlet 5 in a unit time. Since the air inlet pipe 15 is fixed on the movable member 10, the air inlet pipe 15 also moves axially while the movable member 10 moves axially. As shown in FIGS. 5 and 6. FIG. 5 shows that in situation of lung inhalation, assuming that the opening of the air outlet 5 is maximum, that is, the width of the air outlet 5 is d.

When the lung inhalation is adjusted to mouth inhalation, the suction nozzle 6 is rotated, the movable member 10 moves down during the rotation of the suction nozzle 6, and the air outlet 5 on the movable member 10 is moved down, the area of the air outlet 5 blocked by the limiting plate 901 is increased, that is, the air outlet 5 is decreased, and the width value of the air outlet 5 is adjusted to d' for mouth inhalation. As shown in FIG. 6. During the process of switching between lung inhalation and mouth inhalation, that is, during the rotation of the suction nozzle 6, the distance between the bottom end surface of the air inlet pipe 15 and the inner bottom surface of the atomization cotton 14 is also changing. As shown in FIGS. 5 and 6, the distance c is longer than the distance c' to prevent small e-liquid drops from being carried into the user's mouth by the air flow. The rotation of the suction nozzle 6 can link multiple directions to adjust the switching between lung inhalation and mouth inhalation, so that the performance of the atomizer is the best when the user smokes, and the user experience is improved. (Lung inhalation is to inhale in the open lungs, at this time, the airflow velocity is fast and the amount of air flow is large. Mouth inhalation is to inhale through the mouth, at this time, the airflow velocity is slow and the amount of air flow is relatively small.)

The electronic cigarette atomizer further comprises a limiting mechanism for preventing the axial movement of the suction nozzle 6 relative to the top cover 9. The limiting mechanism comprises a first limiting step 602 arranged on the inner side wall of the suction nozzle 6, and a second limiting step 902 arranged on the outer side wall of the top cover 9 and matching the first limiting step 602. The second limiting step 902 of the top cover 9 is inserted into the suction nozzle 6 and inverted relative to the first limiting step 602 in the suction nozzle 6 for limiting, so as to limit the axial movement of the suction nozzle 6. However, the suction nozzle can move axially along the axis of the top cover 9.

The top of the inner side wall of the suction nozzle 6 is screwed to the top of the outer side wall of the movable member 10.

An ultrasonic atomization sheet 13 is arranged in the atomization cavity 3, and an e-liquid bin 12 and atomization cotton 14 communicating the e-liquid bin 12 with an atomization surface of the ultrasonic atomization sheet 13 are arranged in the housing 8. The atomizer further comprises an air inlet pipe 15, and the inner cavity of the air inlet pipe 15 forms the air inlet passage 2. An air inlet end of the air inlet pipe 15 is connected to the movable member 10, and an air outlet end of the air inlet pipe 15 is arranged opposite to the atomization cotton 14 on the atomization surface of the ultrasonic atomization sheet 13. The ultrasonic atomization sheet 13 is a solid piezoelectric ceramic sheet.

The adjustment mechanism 7 simultaneously adjusts the air input of the air inlet 1 and the air output of the air outlet 5. By adjusting the air flow at the air inlet 1 and the air outlet 5 of the atomizer simultaneously, the flow rate of air flow in the electronic cigarette atomizer is kept consistent in air input and output phases, which ensures more uniform collision mixing of smoke and air at the air outlet 5, so that the amount and concentration of the smoke entering the user's mouth per unit time are consistent, the phenomenon of condensation caused by accumulation of smoke in the air flow passage between the air inlet 1 and the air outlet 5 can also be avoided, the user is prevented from sucking e-liquid, and the taste of smoke is improved. At the same time, the simultaneous adjustment of the air flow at the air inlet 1 and the air outlet 5 of the atomizer can also meet the needs of users with different lung capacities for different amounts of smoke.

The air inlet 1 is formed on a side wall of the top cover 9, the movable member 10 is provided with an air passage hole 1003 opposite to the air inlet 1 for communicating the air inlet 1 with the air inlet passage 2, and the opening area of the air inlet 1 is smaller than that of the air passage hole 1003. When the movable member 10 moves axially along the top cover 9, the air passage hole 1003 on the movable member 10 moves relative to the air inlet 1 to adjust the amount of air entering the air inlet passage 2.

The housing 8 comprises a bottom cover 17, a lower cover 18, and an upper cover 19 connected sequentially from bottom to top. A second sealing ring 20 is arranged between the lower cover 18 and the bottom cover 17.

The top cover 9 is an e-liquid injection cover and is provided with an e-liquid injection hole 903. The top cover 9 is connected to a top of the upper cover 19. The e-liquid bin 12 is arranged in the top cover 9. A sealing gasket 21 is arranged between the top of the e-liquid bin 12 and the top cover 9. The sealing gasket 21 is provided with a through hole 2101 capable of communicating the e-liquid injection hole 903 with the e-liquid bin 12. When no e-liquid is injected, the e-liquid injection hole 903 is misaligned with the through hole 2101, and the e-liquid injection hole 903 is closed to prevent e-liquid leakage from the e-liquid bin 12. When e-liquid is injected, the top cover 9 is rotated to communicate the e-liquid injection hole 903 with the through hole 2101, and the e-liquid injection hole 903 is opened to inject the e-liquid into the e-liquid bin 12.

A connection sleeve 22, the top end of which is connected to the top cover 9, is further arranged in the upper cover 19. An inner sleeve 23 and an outer sleeve 24 are arranged in the connection sleeve 22, and the outer sleeve 24 is sleeved outside the inner sleeve 23. The atomization cotton 14 is cup-shaped, a side wall of the cup-shaped atomization cotton 14 is sandwiched between the inner sleeve 23 and the outer sleeve 24, and an outer bottom surface of the cup-shaped atomization cotton 14 is in contact with the ultrasonic atomization sheet 13. A lower segment of the air inlet pipe 15 extends into the inner sleeve 23 and an outlet of the lower segment of the air inlet pipe 15 is opposite to the inner bottom surface of the atomization cotton 14. A cotton pressing spring 25 is further arranged in the cup-shaped atomization cotton 14, one end of the cotton pressing spring 25 abuts against the inner sleeve 23, and the other end of the cotton pressing spring 25 abuts against the inner bottom surface of the cup-shaped atomization cotton 14.

The atomization cavity 3 is arranged in the bottom cover 17. The ultrasonic atomization sheet 13 is fixed in the atomization cavity 3 through an atomization seat 26. A bottom of the bottom cover 17 is provided with a threaded seat 27 for sealing.

A lower electrode 28 is arranged in the threaded seat 27, and the lower electrode 28 abuts against the ultrasonic atomization sheet 13 through a spring electrode 29. The lower electrode 28 is connected to the threaded seat 27 in an insulating manner by an insulating ring 30. The bottom cover 17, the bottom electrode 28, the spring electrode 29 and the insulating ring 30 form a bottom cover component 31, which facilitates assembly.

Embodiment 2

Figure 7:
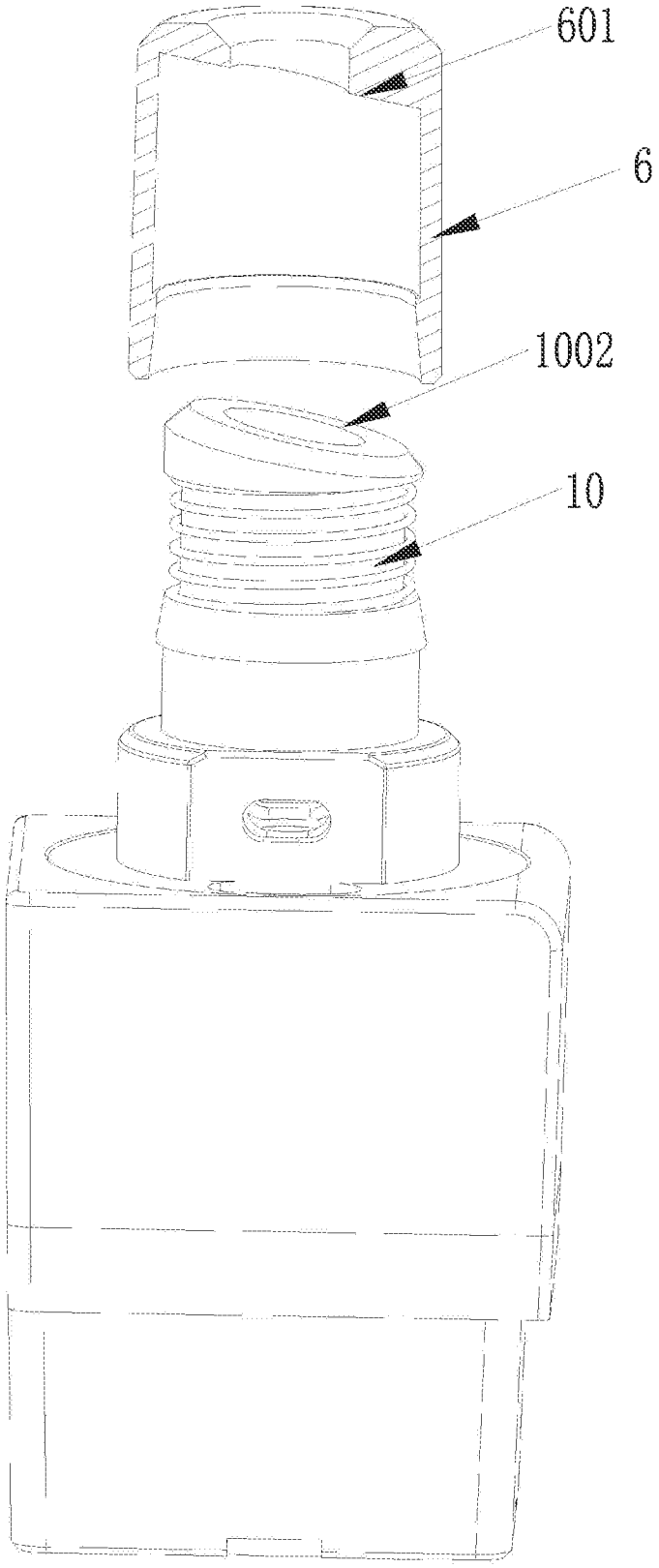
FIG. 7 is an exploded view of a part of Embodiment 2 of an atomizer.
Figure 8:
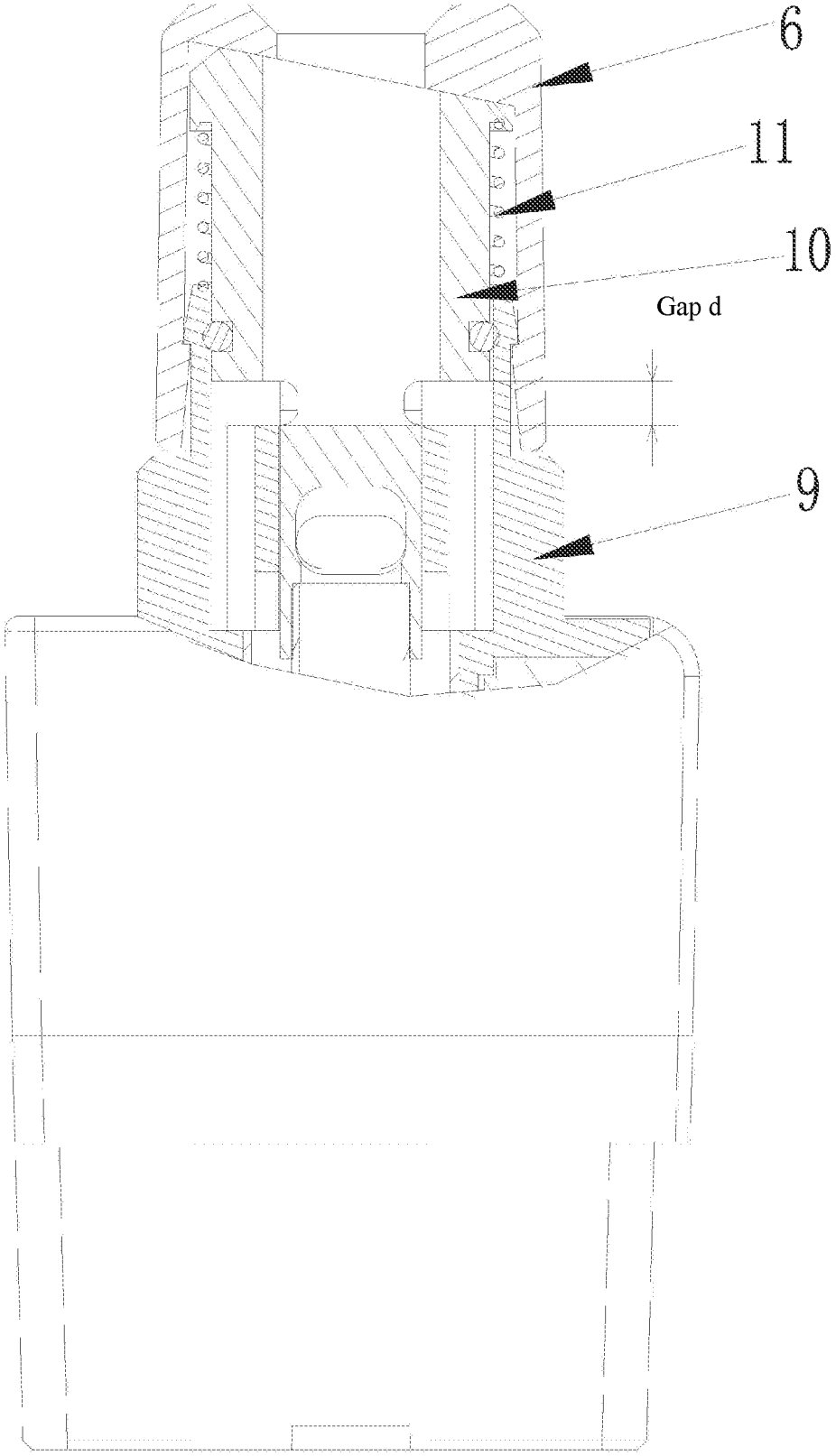
FIG. 8 is a diagram of a use state when the air output of the air outlet is maximum in Embodiment 2.
Figure 9:
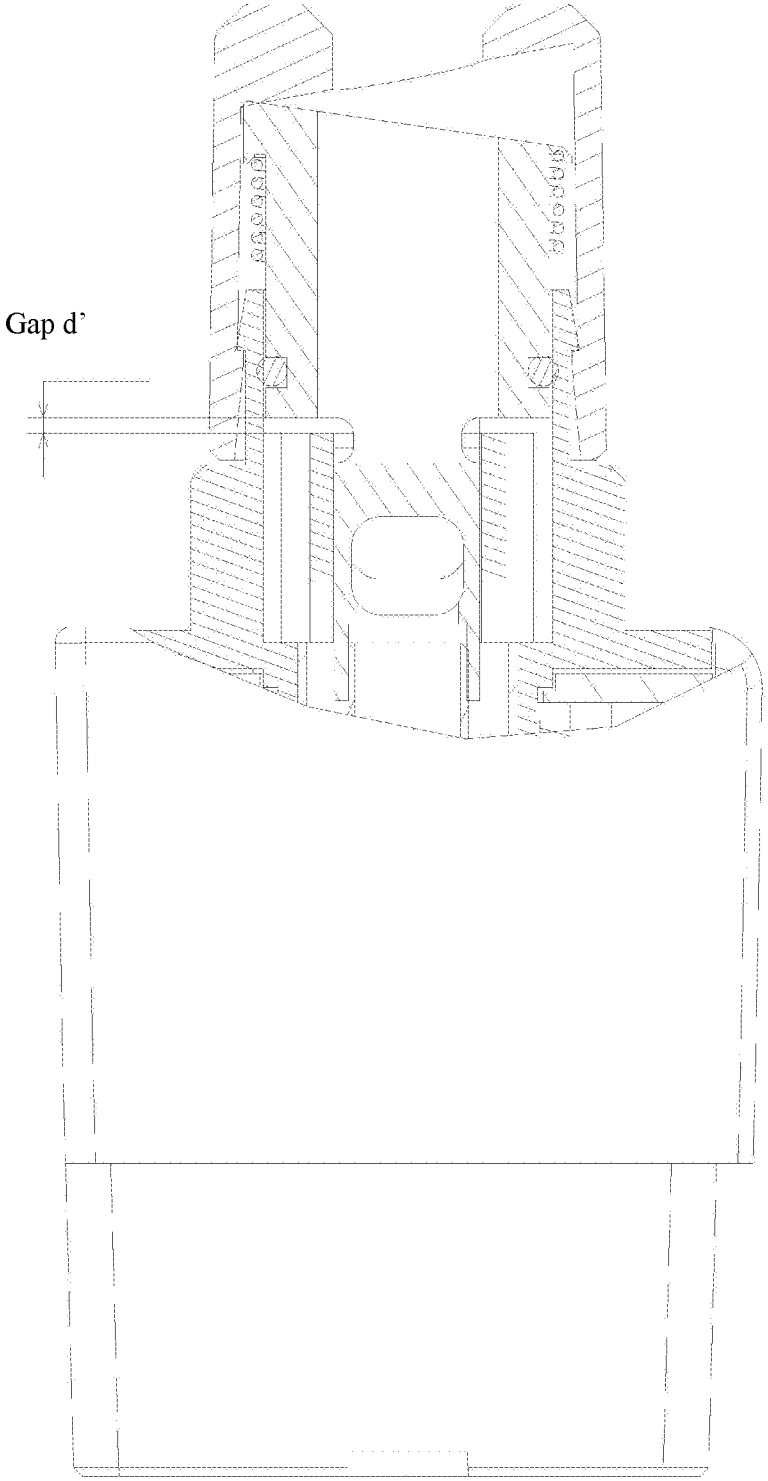
FIG. 9 is a diagram of a use state when the air output of the air outlet is minimum in Embodiment 2.
Figure 10:
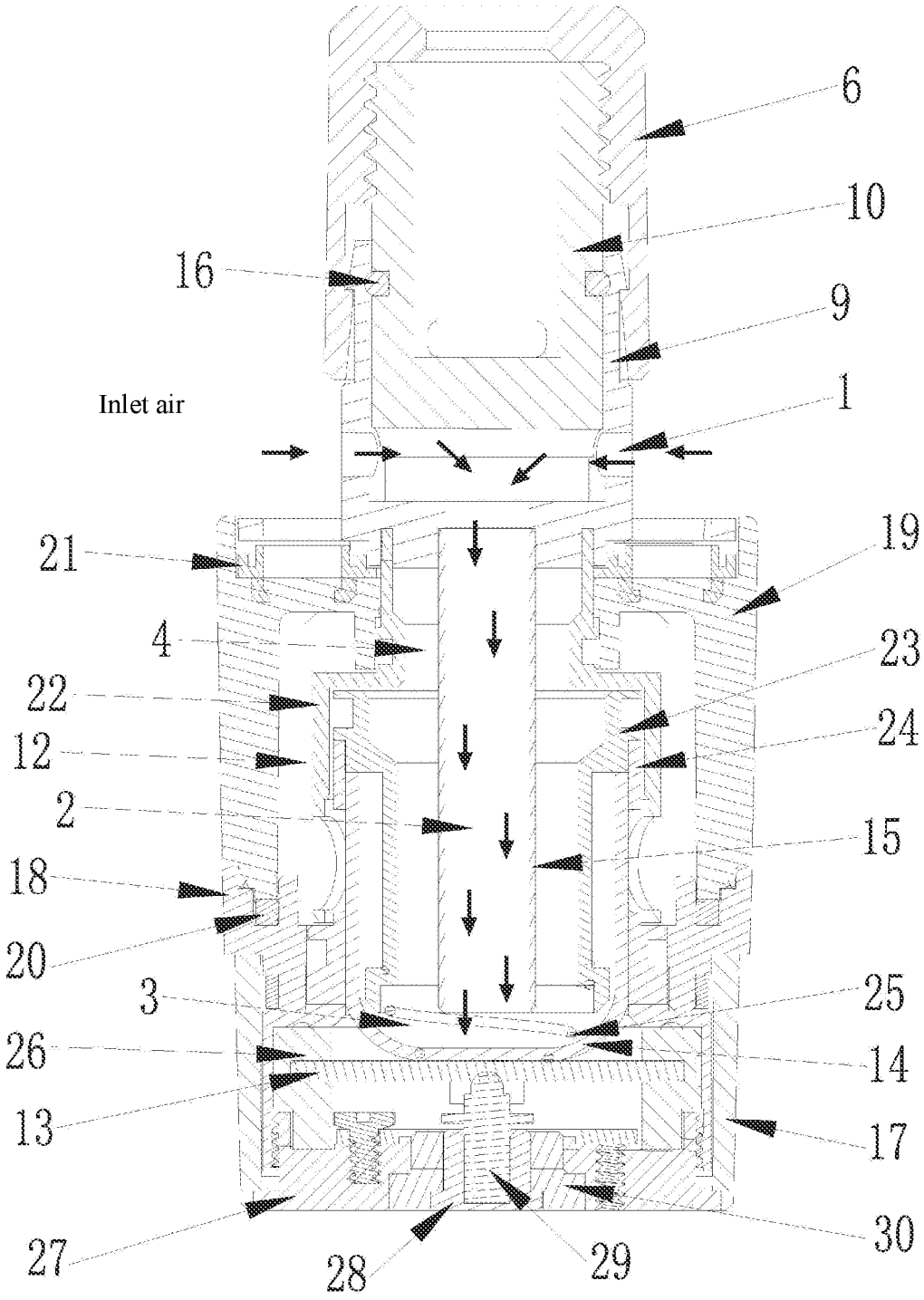
FIG. 10 is a schematic structural diagram of Embodiment 3 of an atomizer.
Figure 11:
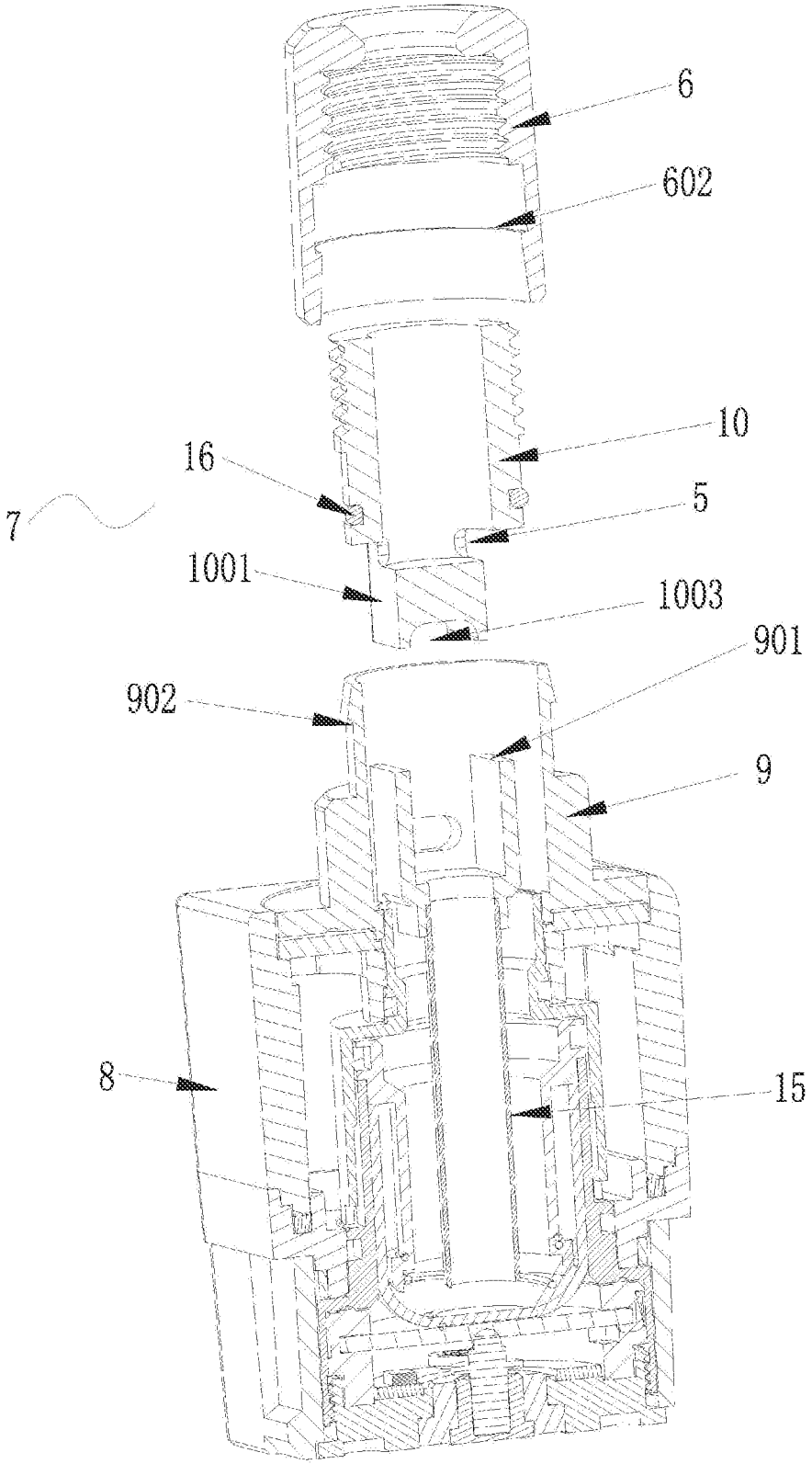
FIG. 11 is a partially exploded view of FIG. 10.
Figure 12:
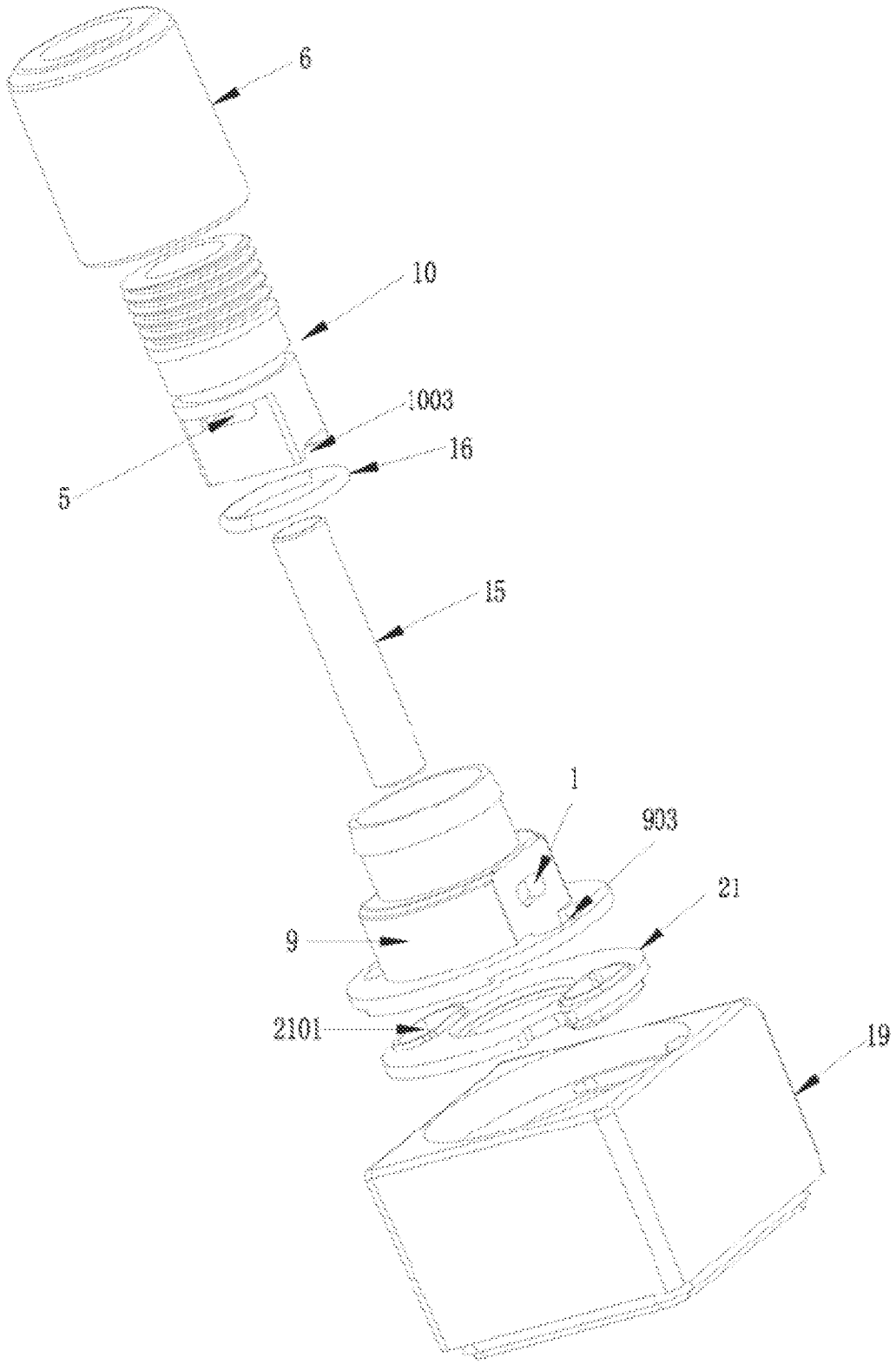
FIG. 12 is an exploded view of the upper part in FIG. 10.
Figure 13:
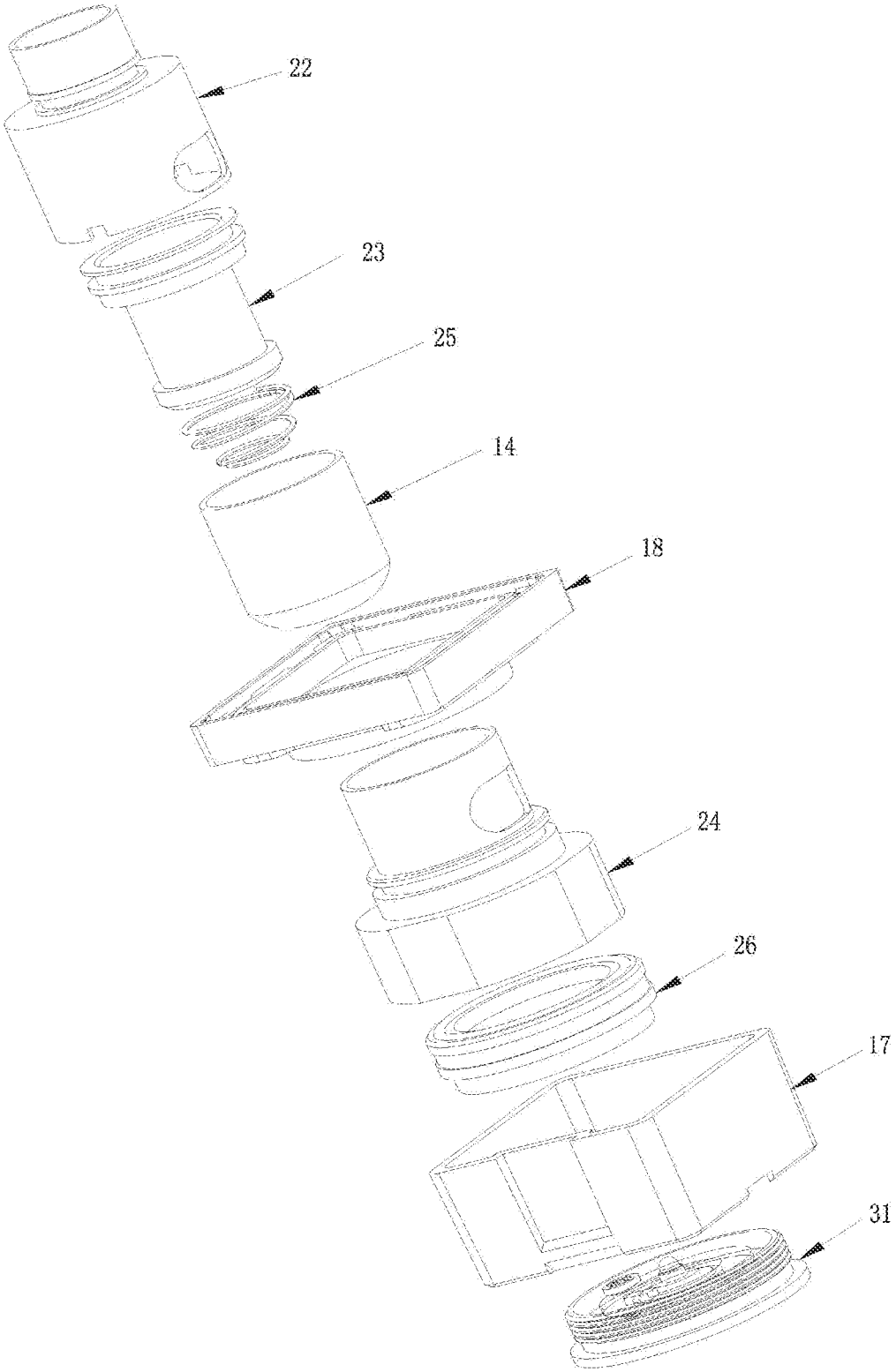
FIG. 13 is an exploded view of the lower part in FIG. 10.

As shown in FIGS. 7-9, embodiment 2 of the electronic cigarette atomizer is the same as embodiment 1 except that the inner top surface of the suction nozzle 6 is a first inclined surface 601, and the outer top surface of the movable member 10 is a second inclined surface 1002. A reset spring 11 is sleeved outside the movable member 10, one end of the reset spring 11 abuts against a boss of the side wall of the movable member 10, and the other end of the reset spring 11 abuts against the top of the top cover 9. When the high end of the first inclined surface 601 abuts against the high end of the second inclined surface 1002 and the low end of the first inclined surface 601 abuts against the low end of the second inclined surface 1002, the area of the air outlet 5 blocked by the limiting plate 901 is minimum and the opening of the air outlet 5 is maximum. When the high end of the first inclined surface 601 is opposite to the low end of the second inclined surface 1002 and the low end of the first inclined surface 601 abuts against the high end of the second inclined surface 1002, the area of the air outlet 5 blocked by the limiting plate 901 is maximum and the opening of the air outlet 5 is minimum.

The same structure in the second embodiment as in the first embodiment is not described herein, which does not affect the understanding and implementation of the present invention by those skilled in the art.

The suction nozzle 6 is rotated, as shown in FIG. 8, when the high end of the first inclined surface 601 abuts against the high end of the second inclined surface 1002 and the low end of the first inclined surface 601 abuts against the low end of the second inclined surface 1002, the reset spring 11 returns to a normal state, the movable member 10 moves close to the suction nozzle 6 axially along the top cover 9, the area of the air outlet 5 blocked by the limiting plate 901 is minimum and the opening of the air outlet 5 is maximum. The suction nozzle 6 is rotated, as shown in FIG. 9, when the high end of the first inclined surface 601 is opposite to the low end of the second inclined surface 1002 and the low end of the first inclined surface 601 abuts against the high end of the second inclined surface 1002, the reset spring 11 is compressed, the movable member 10 moves away from the suction nozzle 6 axially along the top cover 9, the area of the air outlet 5 blocked by the limiting plate 901 is maximum and the opening of the air outlet 5 is minimum.

Embodiment 3

As shown in FIGS. 10 to 17, embodiment 3 of the electronic cigarette atomizer comprises an air inlet 1, an air inlet passage 2, an atomization cavity 3, an air outlet passage 4, an air outlet 5, and a suction nozzle 6 communicated sequentially, and further comprises an adjustment mechanism 7 for adjusting the air output of the air outlet 5. The adjustment mechanism 7 can simultaneously adjust the air input of the air inlet 1 and the air output of the air outlet 5. The atomization cavity 3 is a cavity with a smoke emitting element inside.

By adjusting the air output of the air outlet 5, air flow (smoke) passing through the air outlet 5 per unit time can be increased or decreased, so as to meet the needs of users with different lung capacities for different smoke adjustment modes. Before smoke passes through the air outlet 5, the smoke is not mixed uniformly with air in the air inlet passage 2. Because the air output area of the air outlet 5 is adjusted and restricted by the adjustment mechanism 7, the flow rate of air flow discharged from the air outlet 5 is changed, then the smoke after passing through the air outlet 5 is mixed with the air more uniformly, and the smoke that finally reaches the suction nozzle 6 has a more delicate taste, which improves the user experience.

By adjusting the air flow at the air inlet 1 and the air outlet 5 of the atomizer simultaneously, the flow rate of air flow in the electronic cigarette atomizer is kept consistent in air input and output phases, which ensures more uniform collision mixing of smoke and air at the air outlet 5, so that the amount and concentration of the smoke entering the user's mouth per unit time are consistent, the phenomenon of condensation caused by accumulation of smoke in the air flow passage between the air inlet 1 and the air outlet 5 can also be avoided, the user is prevented from sucking e-liquid, and the taste of smoke is improved. At the same time, the simultaneous adjustment of the air flow at the air inlet 1 and the air outlet 5 of the atomizer can also meet the needs of users with different lung capacities for different amounts of smoke.

The electronic cigarette atomizer further comprises a housing 8. The air inlet passage 2, the atomization cavity 3, and the air outlet passage 4 are all arranged in the housing 8. The top of the housing 8 is provided with a top cover 9.

The adjustment mechanism 7 comprises a movable member 10 located in the top cover 9 and movable axially along the top cover 9, the air outlet 5 is formed on a limiting surface 1001 of the movable member 10, a limiting plate 901 opposite to the opening of the air outlet 5 is arranged in the top cover 9. When the movable member 10 moves axially along the top cover 9, the air outlet 5 on the movable member 10 moves relative to the limiting plate 901 to adjust the air output of the air outlet 5.

The air inlet 1 is formed on a side wall of the top cover 9, the movable member 10 is provided with an air passage hole 1003 opposite to the air inlet 1 for communicating the air inlet 1 with the air inlet passage 2, and the opening area of the air inlet 1 is equal to that of the air passage hole 1003. When the movable member 10 moves axially along the top cover 9, an air passage hole 1003 on the movable member 10 moves relative to the air inlet 1, so that the air passage hole 1003 is aligned or misaligned with the air inlet 1 to adjust the amount of air entering the air inlet passage 2.

The suction nozzle 6 is sleeved outside the top cover 9 and is rotatable relative to the top cover 9. The rotation of the suction nozzle 6 drives the movable member 10 to move axially along the top cover 9.

The electronic cigarette atomizer further comprises a limiting mechanism for preventing the axial movement of the suction nozzle 6 relative to the top cover 9. The top of the inner side wall of the suction nozzle 6 is screwed to the top of the outer side wall of the movable member 10.

The limiting mechanism comprises a first limiting step 602 arranged on the inner side wall of the suction nozzle 6, and a second limiting step 902 arranged on the outer side wall of the top cover 9 and matching the first limiting step 602.

Figure 14:
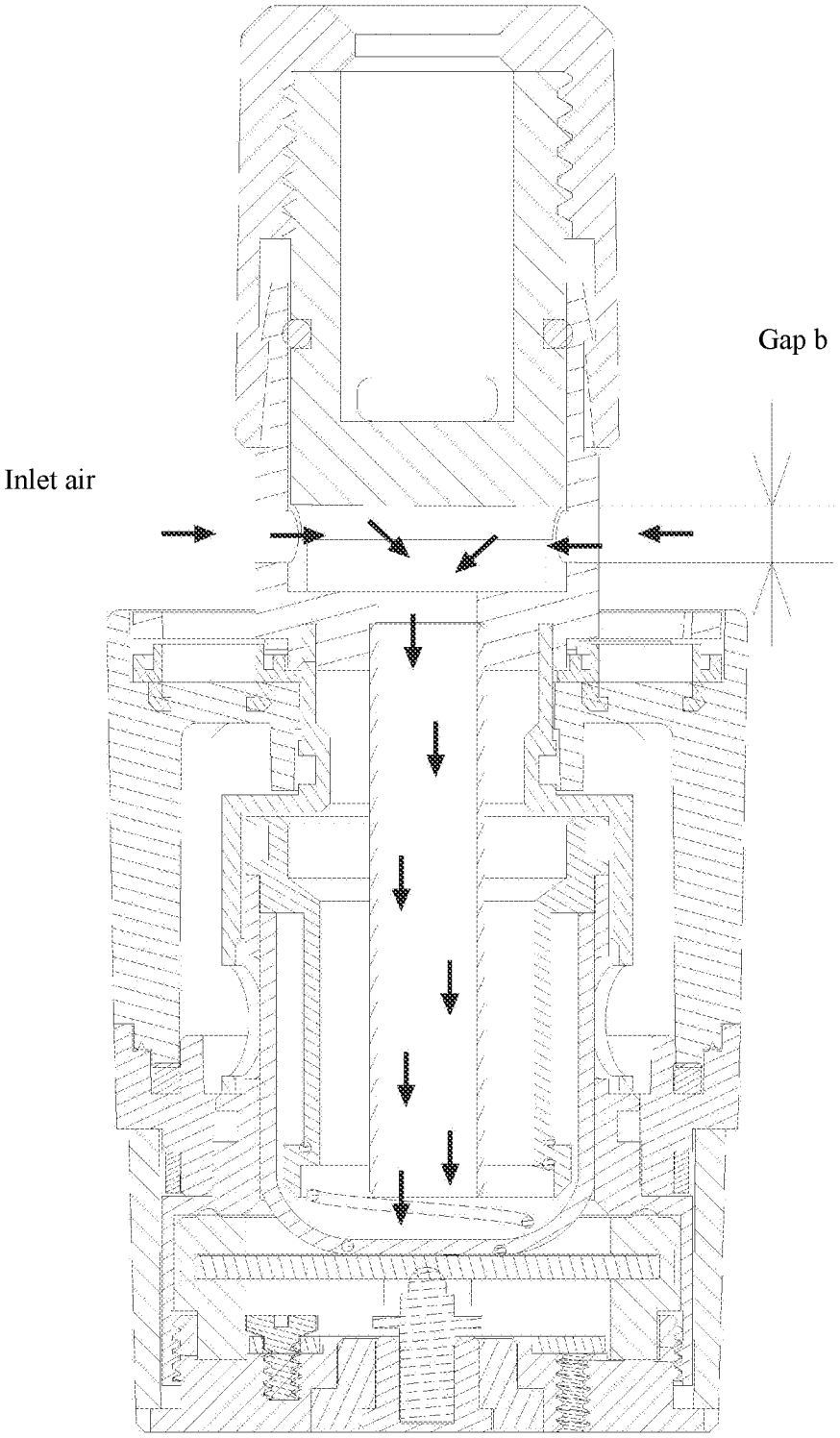
FIG. 14 is a diagram of a use state when the air input of the air inlet is maximum in FIG. 10.
Figure 15:
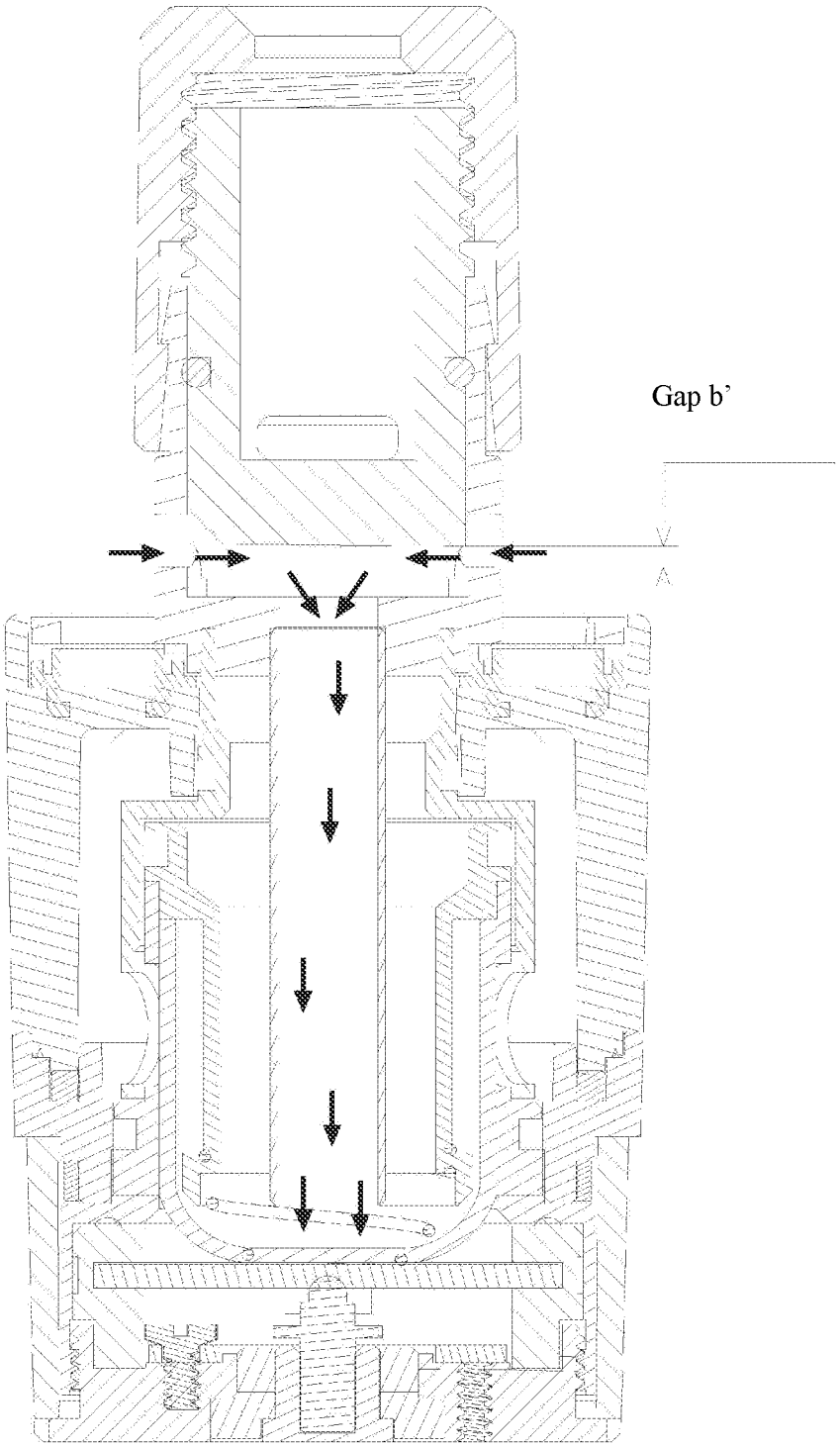
FIG. 15 is a diagram of a use state when the air input of the air inlet is smaller in FIG. 10.
Figure 16:
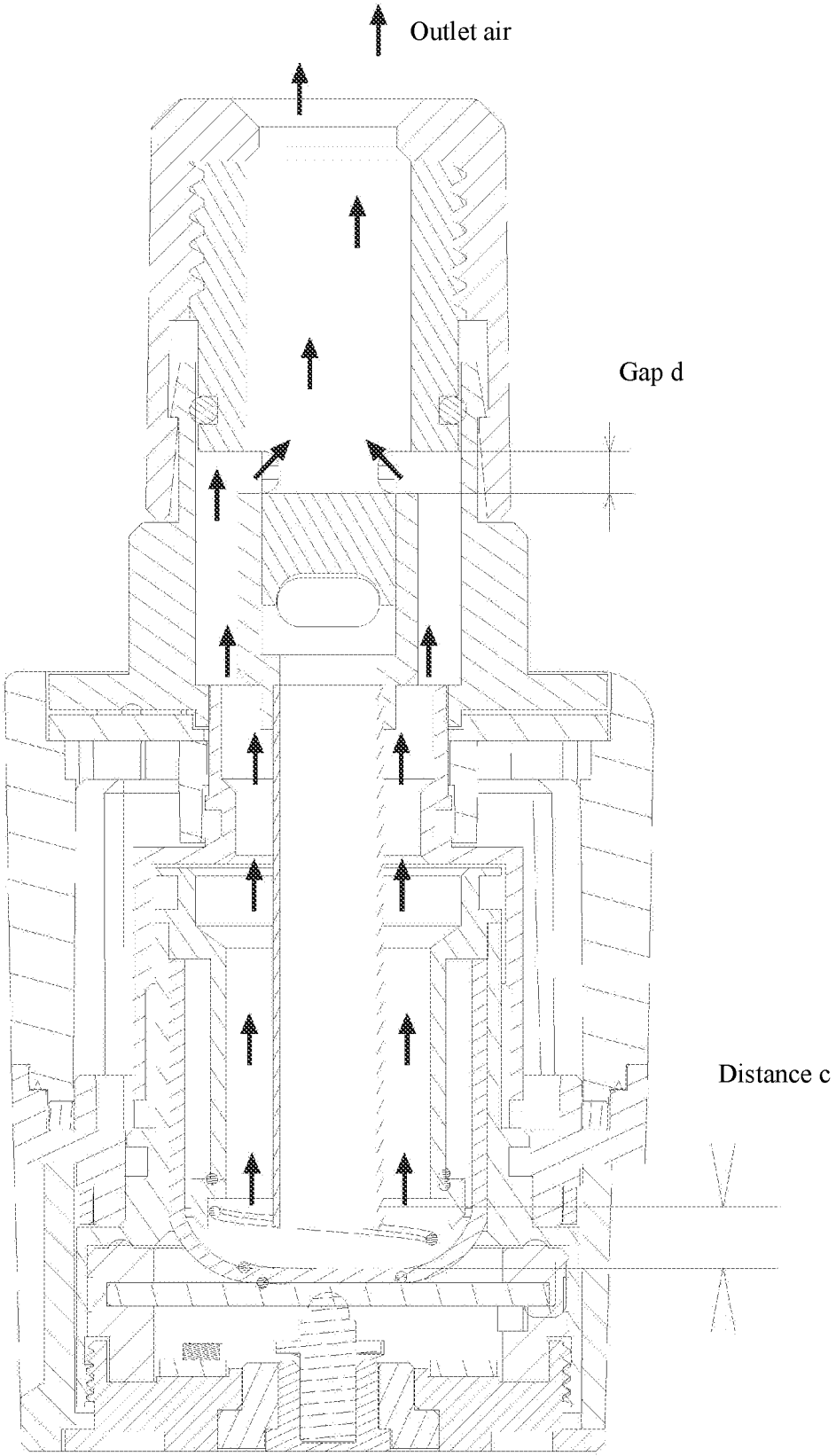
FIG. 16 is a diagram of a use state when the air output of the air outlet is maximum in FIG. 10.
Figure 17:
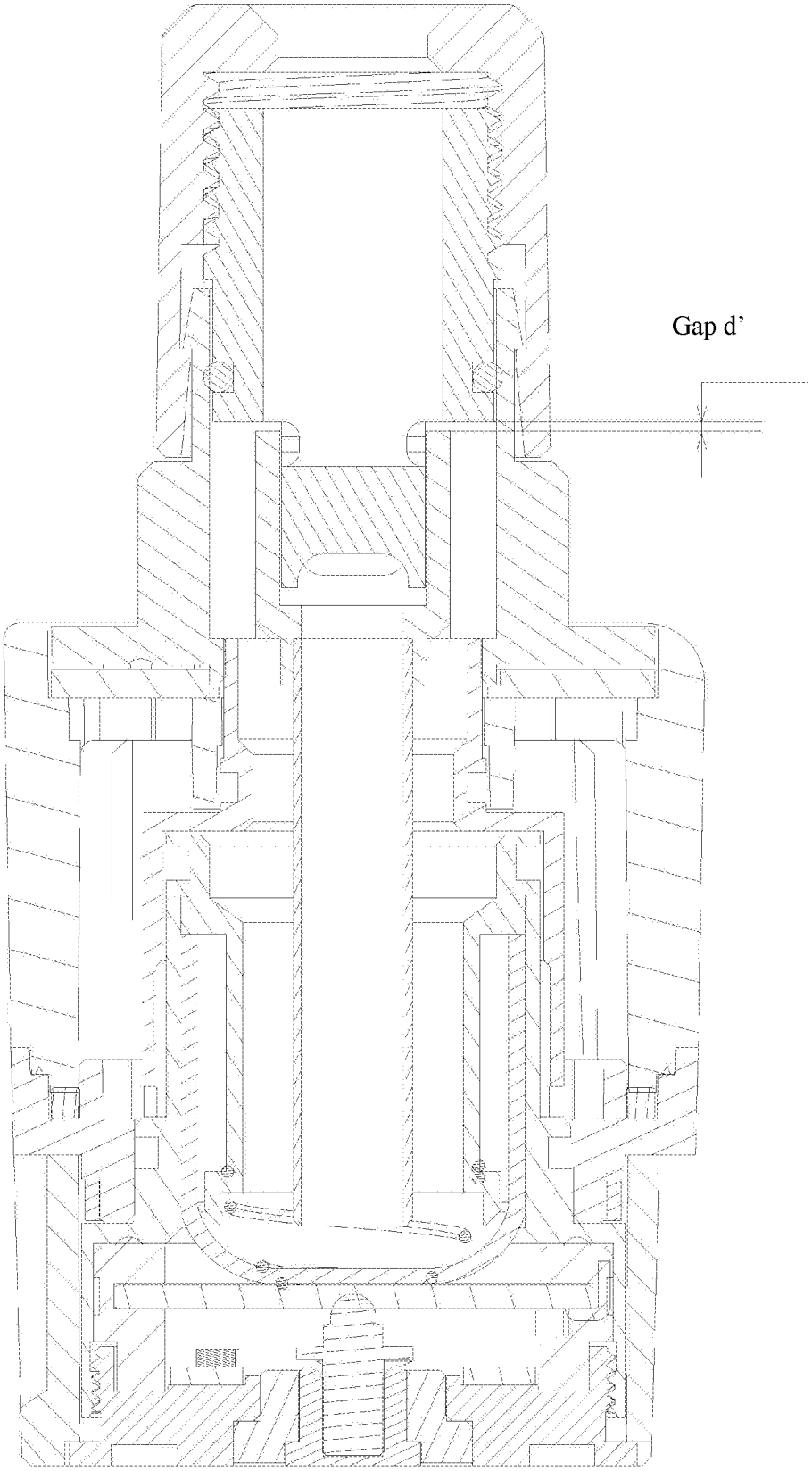
FIG. 17 is a diagram of a use state when the air output of the air outlet is smaller in FIG. 10.

An ultrasonic atomization sheet 13 is arranged in the atomization cavity 3. An e-liquid bin 12 and atomization cotton 14 communicating the e-liquid bin 12 with an atomization surface of the ultrasonic atomization sheet 13 are arranged in the housing 8. The atomizer further comprises an air inlet pipe 15, and the inner cavity of the air inlet pipe 15 forms the air inlet passage 2. An air inlet end of the air inlet pipe 15 is connected to the top cover 9, and an air outlet end of the air inlet pipe 15 is opposite to the atomization cotton 14 on the atomization surface of the ultrasonic atomization sheet 13. When the suction nozzle 6 is rotated, the movable member 10 moves axially under the drive of the suction nozzle 6, thereby adjusting the area of the air outlet 5 blocked by the limiting plate 901 to increase or decrease the air flow passing through the air outlet 5 in a unit time, and adjusting the aligned area of the air inlet 1 and the air passage hole 1003 to increase or decrease the air flow passing through the air inlet 1 in a unit time. As shown in FIGS. 14 and 15, the air inlet gap b of the air inlet 1 in FIG. 14 is larger than the air inlet gap b' of the air inlet 1 in FIG. 15, due to the rotation of the suction nozzle 6. The movable member 10 moves down during the rotation of the suction nozzle 6, and the air passage hole 1003 on the movable member 10 is moved down, which reduces the aligned and communicated area of the air passage hole 1003 and the air inlet 1, that is, the effect of adjusting the air flow of inlet air is achieved. As shown in FIGS. 16 and 17, the air outlet gap d of the air outlet 5 in FIG. 16 is larger than the air outlet gap d' of the air outlet 5 in FIG. 17 due to the rotation of the suction nozzle 6. The movable member 10 moves down during the rotation of the suction nozzle 6, and the air outlet 5 on the movable member 10 is moved down, which increases the area of the air outlet 5 blocked by the limiting plate 901, that is, the effect of adjusting the air flow of outlet air is achieved. During the axial movement of the movable member 10, the position of the air inlet pipe 15 remains unchanged, that is, the distance c between the bottom end surface of the air inlet pipe 15 and the inner bottom surface of the atomization cotton 14 remains unchanged.

A first sealing ring 16 is arranged between the movable member 10 and the top cover 9. The ultrasonic atomization sheet 13 is a piezoelectric ceramic sheet 1.

The housing 8 comprises a bottom cover 17, a lower cover 18, and an upper cover 18 connected sequentially from bottom to top. A second sealing ring 20 is arranged between the lower cover 18 and the bottom cover 17.

The top cover 9 is an e-liquid injection cover and is provided with an e-liquid injection hole 903. The top cover 9 is connected to a top of the upper cover 18. The e-liquid bin 12 is arranged in the top cover 9. A sealing gasket 21 is arranged between the top of the e-liquid bin 12 and the top cover 9. The sealing gasket 21 is provided with a through hole 2101 capable of communicating the e-liquid injection hole 903 with the e-liquid bin 12. When no e-liquid is injected, the e-liquid injection hole 903 is misaligned with the through hole 2101, and the e-liquid injection hole 903 is closed to prevent e-liquid leakage from the e-liquid bin 12. When e-liquid is injected, the top cover 9 is rotated to communicate the e-liquid injection hole 903 with the through hole 2101, and the e-liquid injection hole 903 is opened to inject the e-liquid into the e-liquid bin 12.

A connection sleeve 22, the top end of which is connected to the top cover 9, is further arranged in the upper cover 18. An inner sleeve 23 and an outer sleeve 24 are arranged in the connection sleeve 22, and the outer sleeve 24 is sleeved outside the inner sleeve 23. A side wall of the cup-shaped atomization cotton 14 is sandwiched between the inner sleeve 23 and the outer sleeve 24, and an outer bottom surface of the cup-shaped atomization cotton 14 is in contact with the ultrasonic atomization sheet 13. A lower segment of the air inlet pipe 15 extends into the inner sleeve 23 and an outlet of the lower segment of the air inlet pipe 15 is opposite to the inner bottom surface of the atomization cotton 14. A cotton pressing spring 25 is further arranged in the cup-shaped atomization cotton 14, one end of the cotton pressing spring 25 abuts against the inner sleeve 23, and the other end of the cotton pressing spring 25 abuts against the inner bottom surface of the cup-shaped atomization cotton 14.

The atomization cavity 3 is arranged in the bottom cover 17. The ultrasonic atomization sheet 13 is fixed in the atomization cavity 3 through an atomization seat 26.

A bottom of the bottom cover 17 is provided with a threaded seat 27 for sealing.

A lower electrode 28 is arranged in the threaded seat 27, and the lower electrode 28 abuts against the ultrasonic atomization sheet 13 through a spring electrode 29. The lower electrode 28 is connected to the threaded seat 27 in an insulating manner by an insulating ring 30. The bottom cover 17, the bottom electrode 28, the spring electrode 29 and the insulating ring 30 form a bottom cover component 31, which facilitates assembly.

The embodiments of the present invention are described above with reference to the drawings, but the present invention is not limited to the specific embodiments. The specific embodiments described above are merely illustrative but not limited. Many forms may also be made by those of ordinary skill in the art under the enlightenment of the present invention without departing from the purpose of the present invention and the scope of the claims, and all these forms fall into the scope of the present invention.

The invention claimed is:

1. An electronic cigarette atomizer, comprising:

an air inlet (1), an air inlet passage (2), an atomization cavity (3), an air outlet passage (4), an air outlet (5), and a suction nozzle (6) communicated sequentially, wherein the electronic cigarette atomizer is characterized in that it further comprises an adjustment mechanism (7) for adjusting an air output of the air outlet (5);

a housing (8), wherein:

the air inlet passage (2), the atomization cavity (3), and the air outlet passage (4) are all arranged in the housing (8);

a top of the housing (8) is provided with a top cover (9);

the adjustment mechanism (7) comprises a movable member (10) located in the top cover (9) and movable axially along the top cover (9), wherein the suction nozzle (6) is sleeved outside the top cover (9) and is screwed to the top cover (9), a top of an inner side wall of the suction nozzle (6) is screwed to a top of an outer side wall of the movable member (10), and a screw direction movement of the suction nozzle (6) drives the movable member (10) to move axially along the top cover (9), the movable member (10) is provided with the air outlet (5), and a limiting plate (901) opposite to an opening of the air outlet (5) is arranged in the top cover (9); and when the movable member (10) moves axially along the top cover (9), the air outlet (5) on the movable member (10) moves relative to the limiting plate (901) to adjust the air output of the air outlet (5); wherein:

an inner top surface of the suction nozzle (6) is a first inclined surface (601), and an outer top surface of the movable member (10) is a second inclined surface (1002);

a reset spring (11) is sleeved outside the movable member (10), one end of the reset spring (11) abuts against a boss of the side wall of the movable member (10), and another end of the reset spring (11) abuts against a top of the top cover (9);

when a high end of the first inclined surface (601) abuts against a high end of the second inclined surface (1002), and a low end of the first inclined surface (601) abuts against a low end of the second inclined surface (1002), an area of the air outlet (5) blocked by the limiting plate (901) is minimum and the opening of the air outlet (5) is maximum; and when the high end of the first inclined surface (601) is opposite to the low end of the second inclined surface (1002), and the low end of the first inclined surface (601) abuts against the high end of the second inclined surface (1002), the area of the air outlet (5) blocked by the limiting plate (901) is maximum and the opening of the air outlet (5) is minimum.

2. The electronic cigarette atomizer according to claim 1, wherein the adjustment mechanism (7) simultaneously adjusts an air input of the air inlet (1) and the air output of the air outlet (5).

3. The electronic cigarette atomizer according to claim 1, wherein:

the air inlet (1) is formed on a side wall of the top cover (9), the movable member (10) is provided with an air passage hole (1003) opposite to the air inlet (1) for communicating the air inlet (1) with the air inlet passage (2), and an opening area of the air inlet (1) is smaller than or equal to that of the air passage hole (1003).

4. The electronic cigarette atomizer according to claim 1, further comprising a limiting mechanism for preventing an axial movement of the suction nozzle (6) relative to the top cover (9).

5. The electronic cigarette atomizer according to claim 4, wherein the limiting mechanism comprises:

a first limiting step (602) arranged on the inner side wall of the suction nozzle (6), and a second limiting step (902) arranged on the outer side wall of the top cover (9) and matching the first limiting step (602).

6. The electronic cigarette atomizer according to claim 1, wherein:

an ultrasonic atomization sheet (13) is arranged in the atomization cavity (3), and an e-liquid bin (12) and atomization cotton (14) communicating the e-liquid bin (12) with an atomization surface of the ultrasonic atomization sheet (13) are arranged in the housing (8);

the atomizer further comprises an air inlet pipe (15), and an inner cavity of the air inlet pipe (15) forms the air inlet passage (2);

an air inlet end of the air inlet pipe (15) is connected to the movable member (10), and an air outlet end of the air inlet pipe (15) is arranged opposite to the atomization cotton (14) on the atomization surface of the ultrasonic atomization sheet (13).

7. The electronic cigarette atomizer according to claim 1, wherein:

an ultrasonic atomization sheet (13) is arranged in the atomization cavity (3), and an e-liquid bin (12) and atomization cotton (14) communicating the e-liquid bin (12) with an atomization surface of the ultrasonic atomization sheet (13) are arranged in the housing (8);

the atomizer further comprises an air inlet pipe (15), and the inner cavity of the air inlet pipe (15) forms the air inlet passage (2);

an air inlet end of the air inlet pipe (15) is connected to the top cover (9), and an air outlet end of the air inlet pipe (15) is opposite to the atomization cotton (14) on the atomization surface of the ultrasonic atomization sheet (13).

8. The electronic cigarette atomizer according to claim 1, wherein a first sealing ring (16) is arranged between the movable member (10) and the top cover (9).

9. An electronic cigarette, comprising an electronic cigarette atomizer, wherein the electronic cigarette atomizer comprises:

an air inlet (1), an air inlet passage (2), an atomization cavity (3), an air outlet passage (4), an air outlet (5), and a suction nozzle (6) communicated sequentially, wherein the electronic cigarette atomizer is characterized in that it further comprises an adjustment mechanism (7) for adjusting an air output of the air outlet (5);

a housing (8), wherein:

the air inlet passage (2), the atomization cavity (3), and the air outlet passage (4) are all arranged in the housing (8);

a top of the housing (8) is provided with a top cover (9);

the adjustment mechanism (7) comprises a movable member (10) located in the top cover (9) and movable axially along the top cover (9), wherein the suction nozzle (6) is sleeved outside the top cover (9) and is screwed to the top cover (9), a top of an inner side wall of the suction nozzle (6) is screwed to a top of an outer side wall of the movable member (10), and a screw direction movement of the suction nozzle (6) drives the movable member (10) to move axially along the top cover (9), the movable member (10) is provided with the air outlet (5), and a limiting plate (901) opposite to an opening of the air outlet (5) is arranged in the top cover (9); and when the movable member (10) moves axially along the top cover (9), the air outlet (5) on the movable member (10) moves relative to the limiting plate (901) to adjust the air output of the air outlet (5); wherein:

an inner top surface of the suction nozzle (6) is a first inclined surface (601), and an outer top surface of the movable member (10) is a second inclined surface (1002);

a reset spring (11) is sleeved outside the movable member (10), one end of the reset spring (11) abuts against a boss of the side wall of the movable member (10), and another end of the reset spring (11) abuts against a top of the top cover (9);

when a high end of the first inclined surface (601) abuts against a high end of the second inclined surface (1002), and a low end of the first inclined surface (601) abuts against a low end of the second inclined surface (1002), an area of the air outlet (5) blocked by the limiting plate (901) is minimum and the opening of the air outlet (5) is maximum; and when the high end of the first inclined surface (601) is opposite to the low end of the second inclined surface (1002), and the low end of the first inclined surface (601) abuts against the high end of the second inclined surface (1002), the area of the air outlet (5) blocked by the limiting plate (901) is maximum and the opening of the air outlet (5) is minimum.

10. The electronic cigarette according to claim 9, wherein the adjustment mechanism (7) simultaneously adjusts an air input of the air inlet (1) and the air output of the air outlet (5).

11. The electronic cigarette according to claim 9, wherein:

the air inlet (1) is formed on a side wall of the top cover (9), the movable member (10) is provided with an air passage hole (1003) opposite to the air inlet (1) for communicating the air inlet (1) with the air inlet passage (2), and an opening area of the air inlet (1) is smaller than or equal to that of the air passage hole (1003).

12. The electronic cigarette according to claim 9, further comprising a limiting mechanism for preventing an axial movement of the suction nozzle (6) relative to the top cover (9).

* * * * *